US009447644B2

(12) United States Patent
Millet et al.

(10) Patent No.: US 9,447,644 B2
(45) Date of Patent: Sep. 20, 2016

(54) TUBULAR COMPONENT FOR DRILL STEM CAPABLE OF BEING CABLED, AND METHOD FOR MOUNTING A CABLE IN SAID COMPONENT

(75) Inventors: Francois Millet, Antony (FR); Madjid Ladjici, Chevilly Larue (FR); Julien Breche, Mainvilliers (FR)

(73) Assignee: VALLOUREC DRILLING PRODUCTS FRANCE, Cosne-Cours-sur-Loire (FR)

( * ) Notice: Subject to any disclaimer, the term of this patent is extended or adjusted under 35 U.S.C. 154(b) by 461 days.

(21) Appl. No.: 14/002,260

(22) PCT Filed: Feb. 28, 2012

(86) PCT No.: PCT/EP2012/053359

§ 371 (c)(1),
(2), (4) Date: Oct. 28, 2013

(87) PCT Pub. No.: WO2012/116984

PCT Pub. Date: Sep. 7, 2012

(65) Prior Publication Data

US 2014/0102806 A1 Apr. 17, 2014

Related U.S. Application Data

(60) Provisional application No. 61/536,676, filed on Sep. 20, 2011, provisional application No. 61/536,645, filed on Sep. 20, 2011.

(30) Foreign Application Priority Data

Mar. 1, 2011 (FR) ..... 11 00608
Mar. 1, 2011 (FR) ..... 11 00609

(51) Int. Cl.
*E21B 47/12* (2012.01)
*E21B 17/00* (2006.01)
*E21B 17/02* (2006.01)

(52) U.S. Cl.
CPC ..... *E21B 17/003* (2013.01); *E21B 17/026* (2013.01); *E21B 17/028* (2013.01); *E21B 47/12* (2013.01); *Y10T 29/49117* (2015.01); *Y10T 29/49815* (2015.01)

(58) Field of Classification Search
USPC ..... 175/57, 315
See application file for complete search history.

(56) References Cited

U.S. PATENT DOCUMENTS 6,641,434 B2 11/2003 Boyle et al.
6,670,880 B1 12/2003 Hall et al.

(Continued)

FOREIGN PATENT DOCUMENTS

EP 2 224 092 9/2010
FR 2 883 915 A1 10/2006

(Continued)

OTHER PUBLICATIONS

International Search Report Issued Dec. 19, 2012 in PCT/EP12/05359 Filed Feb. 28, 2012.

*Primary Examiner* — Taras P Bemko
(74) *Attorney, Agent, or Firm* — Oblon, McClelland, Maier & Neustadt, L.L.P

(57) ABSTRACT

A tubular component for a drill stem that can be cabled includes a first end zone, a second end zone, a sheath, the sheath extends between the first end zone and the second end zone, and a liner fixed in a bore of the first end zone. The liner includes at least one take-up chamber for a cable disposed in the sheath.

14 Claims, 8 Drawing Sheets

(56) References Cited

U.S. PATENT DOCUMENTS

| | | | |
|---|---|---|---|
| 6,717,501 | B2 | 4/2004 | Hall et al. |
| 2003/0075319 | A1 | 4/2003 | Chau |
| 2004/0244964 | A1 | 12/2004 | Hall et al. |
| 2005/0092499 | A1 | 5/2005 | Hall et al. |
| 2005/0098356 | A1 | 5/2005 | Chau |
| 2005/0115717 | A1 | 6/2005 | Hall et al. |
| 2006/0124291 | A1 | 6/2006 | Chau |
| 2006/0225926 | A1 | 10/2006 | Madhavan et al. |
| 2007/0056723 | A1 | 3/2007 | Hall et al. |
| 2008/0041575 | A1 | 2/2008 | Clark et al. |
| 2009/0322553 | A1 | 12/2009 | Clark et al. |
| 2010/0213942 | A1 | 8/2010 | Lazarev |

FOREIGN PATENT DOCUMENTS

| | | | |
|---|---|---|---|
| FR | 2 936 554 | A1 | 4/2010 |
| FR | 2 940 816 | A1 | 7/2010 |
| WO | 92 04525 | | 3/1992 |

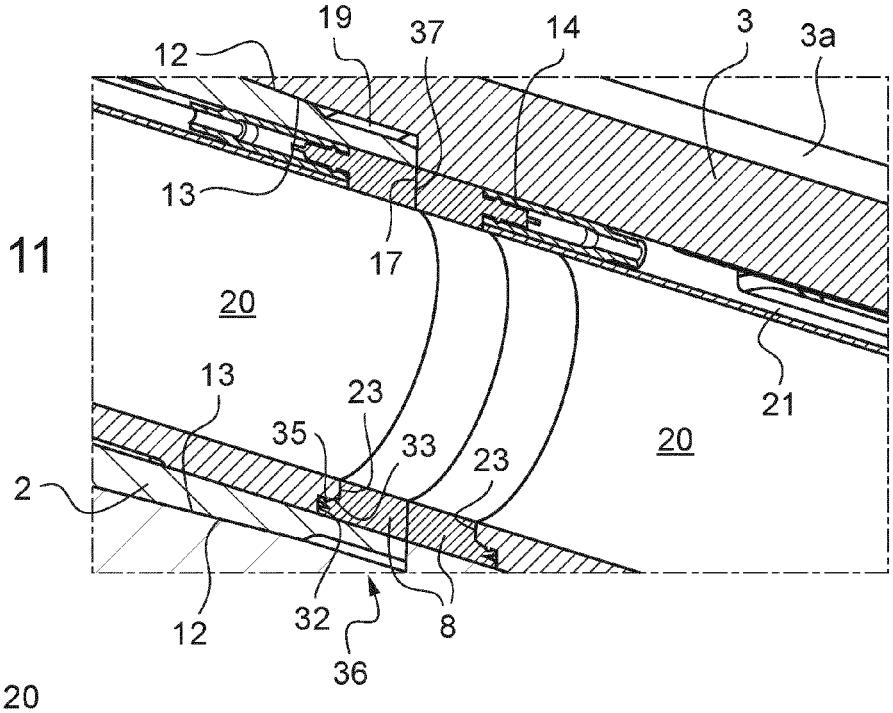
Fig.11
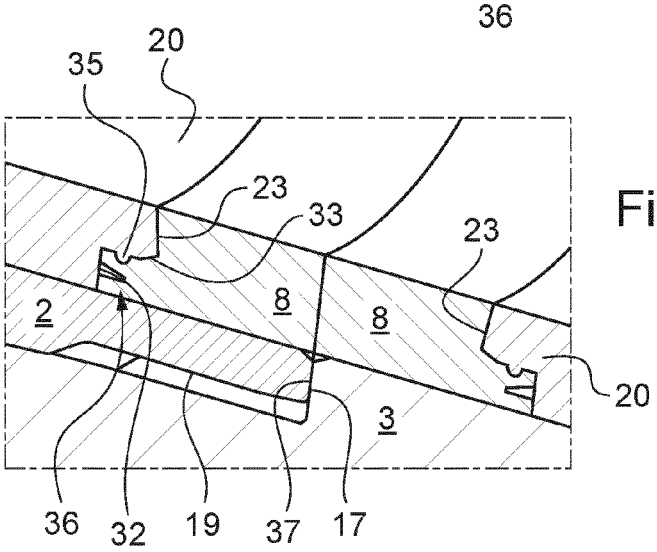
Fig.12
Fig.13
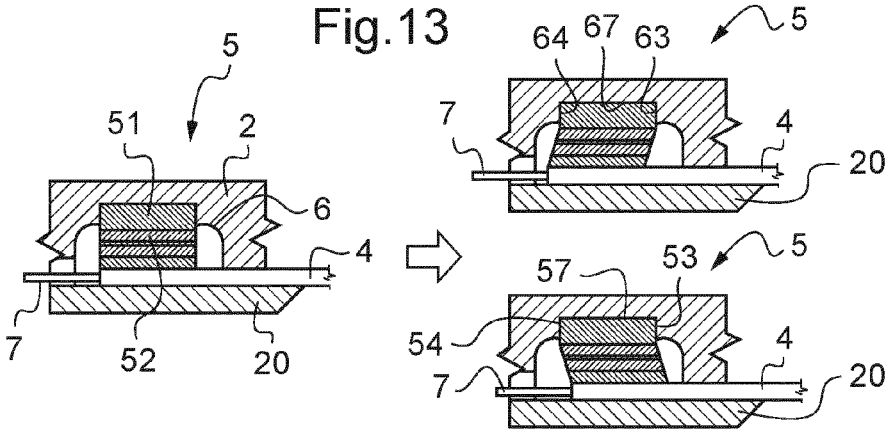

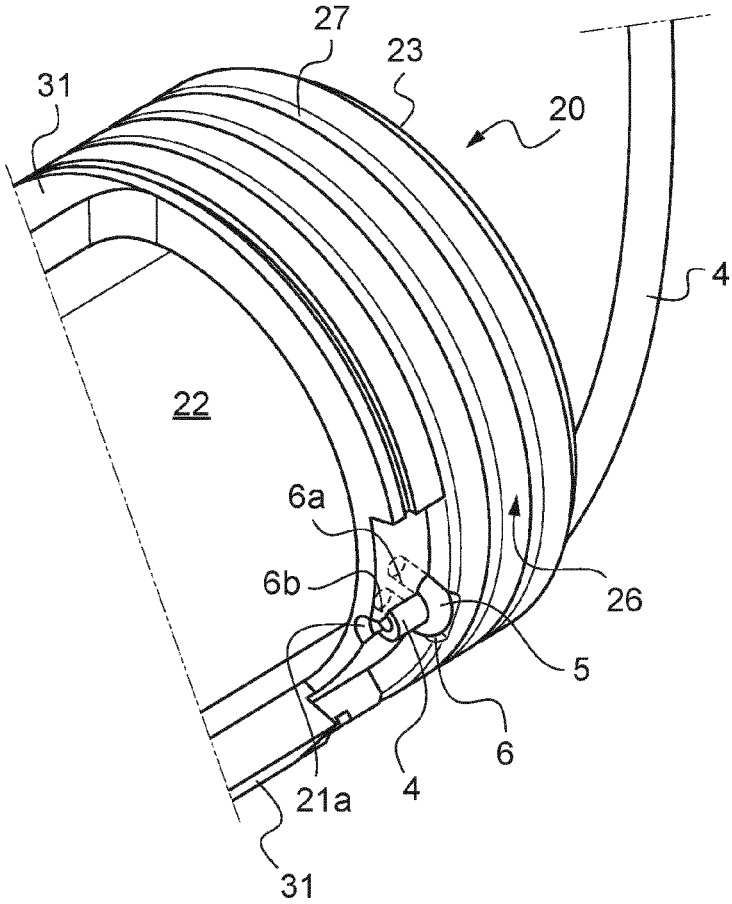
Fig.17B
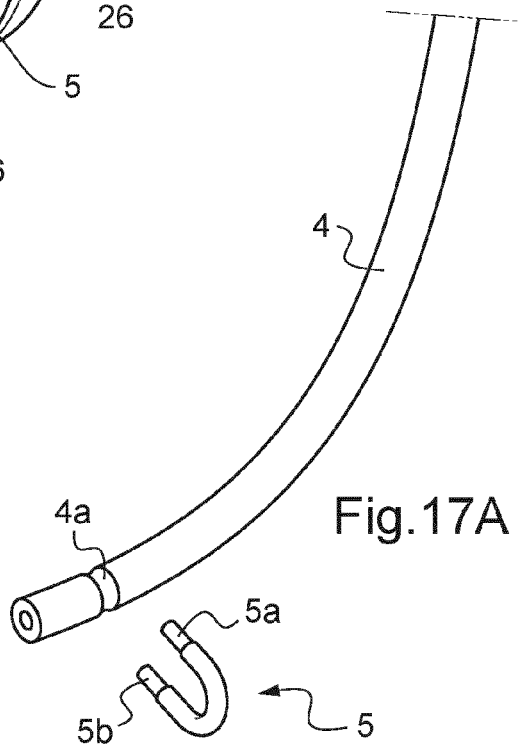
Fig.17A
Fig.18
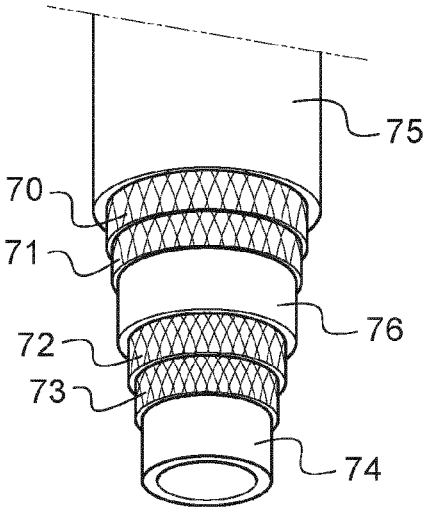

Fig. 19A
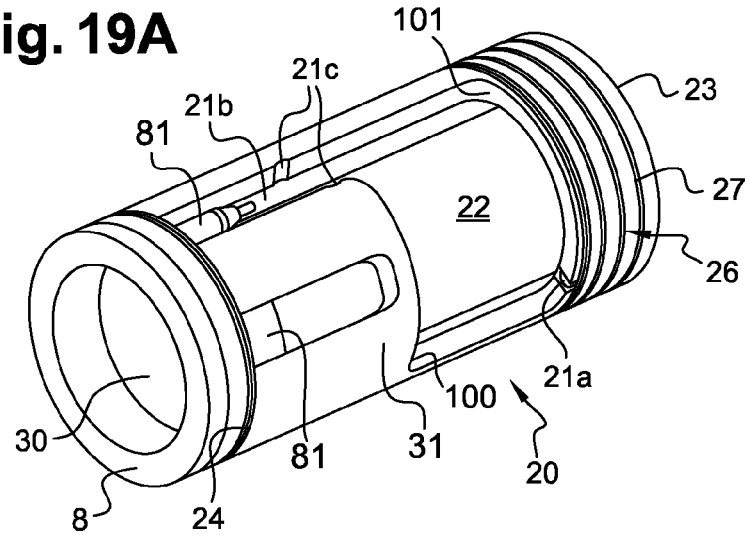
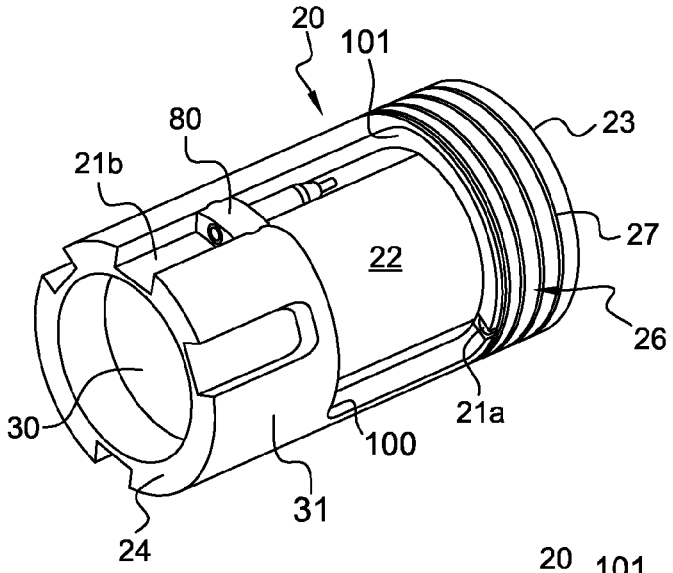
Fig. 19B
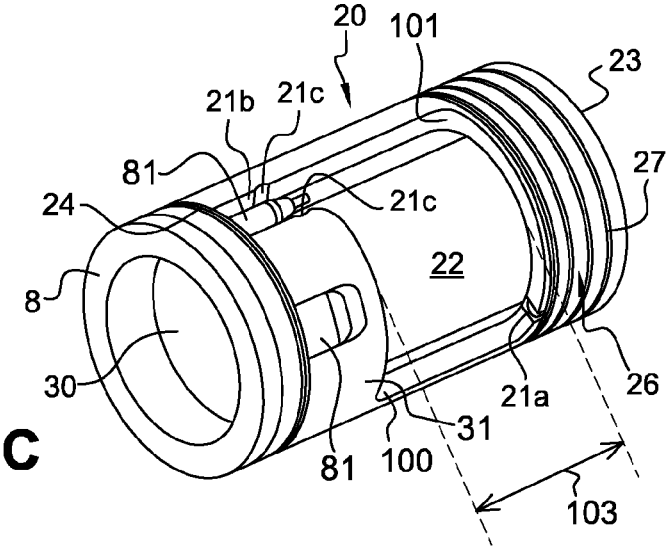
Fig. 19C

TUBULAR COMPONENT FOR DRILL STEM CAPABLE OF BEING CABLED, AND METHOD FOR MOUNTING A CABLE IN SAID COMPONENT

The invention relates to the field of the search for and working of oil or gas fields. Rotary drill strings are used therein, constituted by tubular components such as standard drill strings and possibly heavy weight drill strings as well as other tubulars. The expression "drill string" will be used here, even if only one tube is involved, to denote the passage for mud under pressure in order to actuate a drill bit at the well bottom. The drill string may be rotary with respect to the casing of the well.

More particularly, the invention pertains to a tubular component which is capable of being cabled. Such components can transmit information from one end of drill strings to another.

In order to provide a better understanding of the events occurring at the bottom of a hole, downhole assemblies in the vicinity of the bit may be provided with measuring instruments. The measured data must then be communicated to the surface for processing. Data is generally transferred via a communication cable housed in a communication line. The line is disposed in a drill string, in the regular section bore and in a hole provided in the thickness of the walls at the ends. However, the communication line might vibrate or become displaced, running the risk of premature breakage. Longitudinal and through holes provided in the thickness of the tubular component weaken it and increase manufacturing costs. The performance of the threading of the ends is affected by longitudinal and through holes. Such holes necessitate a compromise between the mechanical strength of said ends and the quality of the connection. Maintenance of the cabling elements in a tubular component is complex.

The invention will improve the situation.

The tubular drill string component is capable of being cabled. The tubular component comprises a first section or first end zone. The tubular component comprises a second section or second end zone. The tubular component comprises a sheath. The sheath extends between the first end zone and the second end zone. The tubular component comprises a liner fixed in a bore of the first end zone. The liner is provided with at least one take-up chamber for a cable disposed in the sheath. The take-up chamber may also be called displacement chamber.

In other words, the invention also pertains to a tubular component for a drill stem which can be cabled, comprising a first end zone, a second end zone and a sheath extending between the first end zone and the second end zone, characterized in that it comprises a cable disposed at least in part in the sheath and a liner, the liner being fixed in a bore of the first end zone and provided with at least one take-up chamber for said cable, the length of the cable being greater than the distance between the first and the second end zone such that the take-up chamber is capable of storing an excess length of said cable.

The first end zone may be male or female. A supplemental liner may be provided in the second end zone. This supplemental liner is then fixed in a bore of the second end zone, this supplemental liner also being provided with at least one take-up chamber for said cable.

Thus, a space is provided for storing a supplemental portion of cable in operation. In operation, this supplemental portion is slack in the chamber. On mounting, dismantling and/or maintenance, the end of the cable, comprising the plug, can be extracted from the tube. This extraction is made possible by the fact that an excess length of cable is passed out of the component. The excess length of cable can be passed out because the supplemental portion of cable is stored, under expansion or slack, in the chamber, for example in a coil, to provide the length of cable with some slack.

This take-up chamber for the cable means that an excess length of said cable can be stored, this excess length meaning that the cable can protrude from the liner during mounting and/or maintenance operations.

In particular, the excess length of cable which is capable of being stored in the take-up chamber of the liner has a dimension, in particular length, which differs from that of the excess length of cable which is capable of being stored in the take-up chamber of the supplemental liner. In fact, the male and female ends have distinct requirements for their excess lengths. The female side requires a longer excess length than the male side. According to the inner configuration of the tubular component, the female side may have a smaller excess length than the male side, because respective take-up chamber of the female side is smaller in length than on the male side.

Advantageously, the outside of the cable may be provided with a retaining stopper to calibrate the length of the cable coming from at least one side of the sheath. Thus, the axial mobility of the cable in the sheath is limited. Positioning such a retaining stopper also means that the excess length of cable to be stored in the take-up chamber can be calibrated. Another advantage of such a retaining stopper is to avoid the displacement of the cable within the sheath when the tubular component is stored vertically on racks or within the hole. During the mounting or maintenance operations, the operator can thus readily take action at the end (or terminal or plug) of the cable away from the first end zone. Visual inspection of the end (or terminal or plug) of the cable is facilitated. The liner may have an elongate channel passing along it which allows the cable to pass from the chamber to the terminal surfaces of the liner. The liner may have an elongate channel passing along it to allow the sheath and/or the cable to pass from the chamber to the terminal surfaces of the liner.

The elongate channel can at least partially fix the sheath in the component. As an example, the elongate channel may limit movement, especially shear movement, between the mouth of the sheath and the portion of cable which protrudes out of it.

A bore of the first end zone may comprise a shoulder in the vicinity of a head terminal surface of the liner. A supplemental groove may be provided through said shoulder. The sheath may be disposed in said supplemental groove.

The supplemental groove fixes the sheath directly with respect to the component. Angular indexing of the sheath in the component is thus predetermined.

The elongate channel or the supplemental groove or both housing the sheath may have a constant section which matches the sheath.

By fitting the channel and/or the supplemental groove around the sheath, the sheath is prevented from being subjected to movements which could damage the mechanical integrity of said sheath or the integrity of the electric connection to a coupler.

The component may comprise a tube having a bore with a constant diameter disposed between the first and the second end zones.

A regular bore in the component facilitates fluid flow.

The liner may comprise an external surface provided with a guide portion and at least one fixing portion.

The guide portion is arranged to facilitate mounting/dismantling operations of the liner and to guide the sheath into the component. The fixing portion means that the liner can be securely fixed in the bore of the component.

The tubular configuration is simple to manufacture. The selected angular sector configuration is cheap as regards materials and keeps a large section for the passage of drilling mud inside the component.

The component may also comprise a conductor cable disposed in the sheath. The component may comprise a means for transmission from one component to another component. Said transmission means may be connected to the cable. Said transmission means may be supported by the liner.

The component provided with a cable and transmission means is ready to be assembled with other components of the drill string. On-site operations are thus limited. This means that mounting operations carried out at the drill site under difficult conditions are reduced, by carrying them out upstream, for example in the factory.

The first end zone of the component may have a sealed annular wall.

The sealed annular wall may act as a stop surface during makeup of two components and may protect the threads of the end zones from drilling mud present in the bore of the tube in operation. Thus, a cheaper, stronger component is obtained which has reduced risks of leakage and mud intrusion.

The component may also comprise a lock to clamp the sheath at least in an axial direction with respect to the first end zone. The lock may be installed in a removable manner in a housing. In particular, the invention also provides a tubular component for a drill stem which can be cabled, comprising a first end zone, a second end zone and a sheath extending between the first end zone and the second end zone, wherein the component comprises a liner fixed in a bore of the first end zone, and provided with an elongate channel for the sheath, and a lock for clamping the sheath in at least an axial direction with respect to the first end zone, said lock being installed in a removable manner in a housing, said lock being held radially in the housing.

The housing may be provided in the first end zone. The housing may be provided in the liner. The lock may be held radially in the housing by the liner. The lock may be held radially in the housing by the first end zone. Thus, the integrity of the end zones can be preserved. This means that specifications concerning non-cabled connections can be complied with.

The presence of the lock means that the sheath enveloping the cable can be fixed in a precise manner which allows facilitated dismantling of the component.

As an example, the lock may be held radially in the housing between the liner and the first end zone.

The lock may comprise at least one elastic element. The elastic element may also be a shock absorber.

The elastic element reduces the damaging mechanical consequences of stresses on the lock in its housing in operation. Vibrations, tensions, torsions etc. are partially absorbed.

The sheath may be held angularly with respect to the axis of the component by the liner. The sheath may be held angularly with respect to the axis of the component by the lock.

The sheath may be disposed in a substantially longitudinal manner between the two end zones of the tubular component. This means that the length of the sheath can be limited. The sheath may be disposed in a substantially or partially helical manner between the two end zones of the tubular component. This has the advantage of providing a large margin for manoeuvre when mounting the sheath in the tubular component, in particular when angularly indexing the liner into the tubular component. Selecting the disposition of the sheath is also a function of the operational behaviour of said sheath optimized for the liquid flow in the drill stem, shocks, vibrations and pressure.

The bore of the first end zone of the component may comprise a shoulder. The thickness of the component may be adapted to strength requirements. Surfaces of the shoulder may act as an abutment for a head terminal surface of the liner. A supplemental groove may be provided through the shoulder. Said supplemental groove is capable of receiving the sheath. The axial continuity of the passage for the sheath between the section provided with a liner and the central portion of the tubular component which has no liner is ensured.

The tubular component may comprise a central portion between the first and the second end zone. The central portion is provided with a substantially cylindrical bore. The central portion of the tubular component may have a maximum internal diameter at the centre, and a minimum in the vicinity of the end zones. The shoulders belong to the end zones. The component may comprise a tube having a constant diameter bore between the first and the second end zones.

The housing which can receive the lock may be annular. Cheaper machining, or even none at all, of the bore of the tubular component is rendered possible. This benefits from freedom as regards angular indexing of the lock and the sheath when mounting. This is advantageous when adjusting the pitch of the helix formed by the sheath in the case of a sheath disposed in a helical manner.

The housing may be limited angularly. The angular position of the lock and the sheath is thus fixed. The angular hold of the sheath-lock assembly during operation is improved.

The elongate channel of the liner housing the sheath may have a constant section which is adjusted to the sheath. This improves the hold on the sheath during operation. The section of the sheath located in the vicinity of the head terminal surface of the liner beyond the liner can be orientated. This is of particular advantage when the sheath is disposed in a helical manner.

The lock may comprise a solid body and/or at least one elastic element. The elastic element may also absorb loads resulting from contacts between the lock and its environment. This allows for greater dimensional tolerance in the manufacture of the lock and its housing. Shocks and/or vibrations of a lock in its housing as well as tensile forces in the sheath are limited.

The sheath, which is axially held in the first end zone by means of a lock, may also be held angularly with respect to the axis of the component by the liner. The sheath, axially held in the first end zone by the lock, may also be angularly held with respect to the axis of the component by the lock. This means that the angular position of the sheath in the first end zone can be fixed.

The angular position of the sheath is thus fixed in operation to adapt it to the stresses which it will undergo, especially linked to the movement of the mud, to shocks and to vibrations.

The sheath and the cable may form a unitary sub-assembly. Said sub-assembly may comprise a coaxial cable.

The function of the cable and the mechanical, chemical and electromagnetic protection functions are thus provided by a unitary part.

The liner may be fixed in a detachable manner. Removing the liner facilitates maintenance operations.

In particular, the lock and the sheath may be free to rotate with respect to each other. The lock and the sheath may be mutually fixed with freedom of rotation with respect to each other. This avoids stress concentrations, in particular torsional stresses, between these two parts. This is particularly appropriate when the sheath is disposed in a helical manner.

In contrast, it is also possible to fix the lock and the sheath with respect to each other in an integral manner. In this case, the lock and the sheath are fixed with respect to each other. This means that simple, cheap techniques can be employed.

The lock may be in the shape of a body of revolution. Angular indexing of the sheath-lock assembly when mounting the tubular component could be dispensed with.

The conductor cable disposed in the sheath comprises a supplemental portion of at least 2 centimeters with respect to the length of the component. Said supplemental portion can be extracted from the component during maintenance.

The take-up chamber may comprise a shoulder formed on the bore of the component.

In the method for mounting a cable in a tubular component of a drill stem, said component comprises a first end zone, a second end zone, a sheath extending between the first end zone and the second end zone and a liner fixed in a bore of the first end zone, said liner being provided with an elongate channel and a take-up chamber for a cable. The cable protrudes out of either side of the component. Said method comprises:

- electrically connecting the cable with a transmission means;
- pushing the excess length of protruding cable into an elongate channel portion. A supplemental portion of cable goes into the take-up chamber.

The invention also concerns a method for mounting a sheath in a tubular drill stem component comprising a first end zone and a second end zone, said method comprising:

- mounting the sheath in the tubular component;
- mounting a lock to clamp the sheath in a housing;
- fixing a liner in the bore of the first end zone, radially clamping the lock in the corresponding housing, the liner being provided with an elongate channel for the sheath. The step for fixing the liner is subsequent to the steps for mounting the sheath and the lock.

The sub-assembly formed by the end zones and a central portion is termed the primary tube. The primary tube is deprived of the sheath, the lock and the liner.

The mounting method may also comprise a step for inserting the cable into the sheath such that the cable protrudes from either end of the sheath. This means that mounting operations at the drill site under difficult conditions can be reduced, by carrying them out upstream, for example at the factory. Thus, risks of maintenance errors are reduced. It might be easier to insert the cable before the other steps, for example deformation of the sheath.

The method may also comprise placing a cable plug located axially on the side of the first end zone of the component in the mounted state in electrical contact with the transmission means, for example by plugging it in. Making electrical contact may be subsequent to inserting the cable into the sheath. By making this connection in a suitable environment, the insertion of damaging debris close to the electrical connections is avoided.

The method may comprise fixing the transmission means to the component. The method may comprise pushing the excess length of cable protruding from the component into the elongate channel portion. Said pushing may cause the supplemental portion of cable to be deployed in the take-up chamber provided in the liner. The transmission means may be fixed after bringing the plug into electrical contact. This can reduce the number of mounting operations carried out at the drill site, under difficult conditions, by carrying them out upstream, for example at the factory. The risks of maintenance errors are therefore reduced. Thus, components which are relatively integral and easily transportable are provided, since the transmission means are at least partially protected by the tubular component.

The steps in the mounting method may be reversible.

The steps may be carried out in the following order: mounting the sheath then mounting the lock then fixing the liner. This facilitates the mounting operation by fixing the lock in its housing once the sheath is in place.

The lock and the sheath may be assembled by welding. This is a cheap operation and means that the lock-sheath assembly can be manipulated during mounting.

The assembly of the lock and the sheath may be replaced by forming a sheath and lock assembly from the sheath. The step for forming the assembly may comprise deforming the sheath, forming a thickened portion. The thickened portion of the sheath forms the lock. This replaces manufacturing the lock and assembling the lock with the sheath by a single step. The assembly of the two elements may be as a single part. This operation may, for example, consist of mushrooming.

The step for fixing the liner may comprise force fitting and/or bonding. Axial positioning of the liner is accomplished by the interaction of surfaces. Rotational indexing is carried out so that an elongate channel provided in the liner for the sheath is brought to face the sheath. This is an inexpensive operation.

The liner fixing step may be reversible. Maintenance operations are facilitated, in particular when the connection elements have to be changed without changing the tubular component.

In the method for dismantling a cabled tubular component of a drill stem, said component comprises: a first end zone, a second end zone, a sheath between the first and second end zone, a liner fixed in a bore of the first end zone, said liner being provided with an elongate channel for the sheath and a cable disposed in the sheath wherein a plug is in electrical contact with a transmission means, said cable comprising an excess length disposed in a portion of the elongate channel and a supplemental slack portion in a take-up chamber provided in the liner. Said device comprises the steps of:

- detaching the transmission means from the component;
- then extracting the excess length of cable from the elongate channel out of the component, extraction causing displacement of the supplemental portion of cable from the take-up chamber towards the elongate channel portion. The method may also comprise electrical separation, for example by unplugging the plug from the cable and the transmission means.

In a method for machining a cabled tubular component device for a drill stem, said component comprises: a first end zone, a second end zone, a sheath between the first and second end zone, a liner fixed in a bore of the first end zone, said liner being provided with an elongate channel for the sheath and a cable disposed in the sheath wherein a plug is in electrical contact with a transmission means, an excess length being disposed in a portion of elongate channel and a supplemental portion of cable being slack in a take-up chamber provided in the liner. Said method comprises the steps of:

detaching the transmission means from the component;

reducing the length of the liner by removing material from a terminal surface of the liner. The method may advantageously comprise protecting the take-up chamber and/or the cable plug by placing a stopper in the elongate groove. Material may then be removed with a reduced risk of degradation of the connection.

The device and the mounting method can be used to fix the sheath in the end zone. The device and the mounting method dispense with major machining, for example punching through the thickness of the tubular component. The fact that the device can be dismantled means that maintenance and repair operations are facilitated. The fact that it can be dismantled means that replacement of certain elements of the tubular component can be limited.

A method for mounting, dismantling or maintenance may include machining one of the terminal surfaces of the liner to match the length of the liner to the distance between a shoulder and a small diameter annular surface of the first end zone of a tubular component.

Other characteristics and advantages of the invention will become apparent from an examination of the following detailed description and the accompanying drawings in which.

Figure 3:
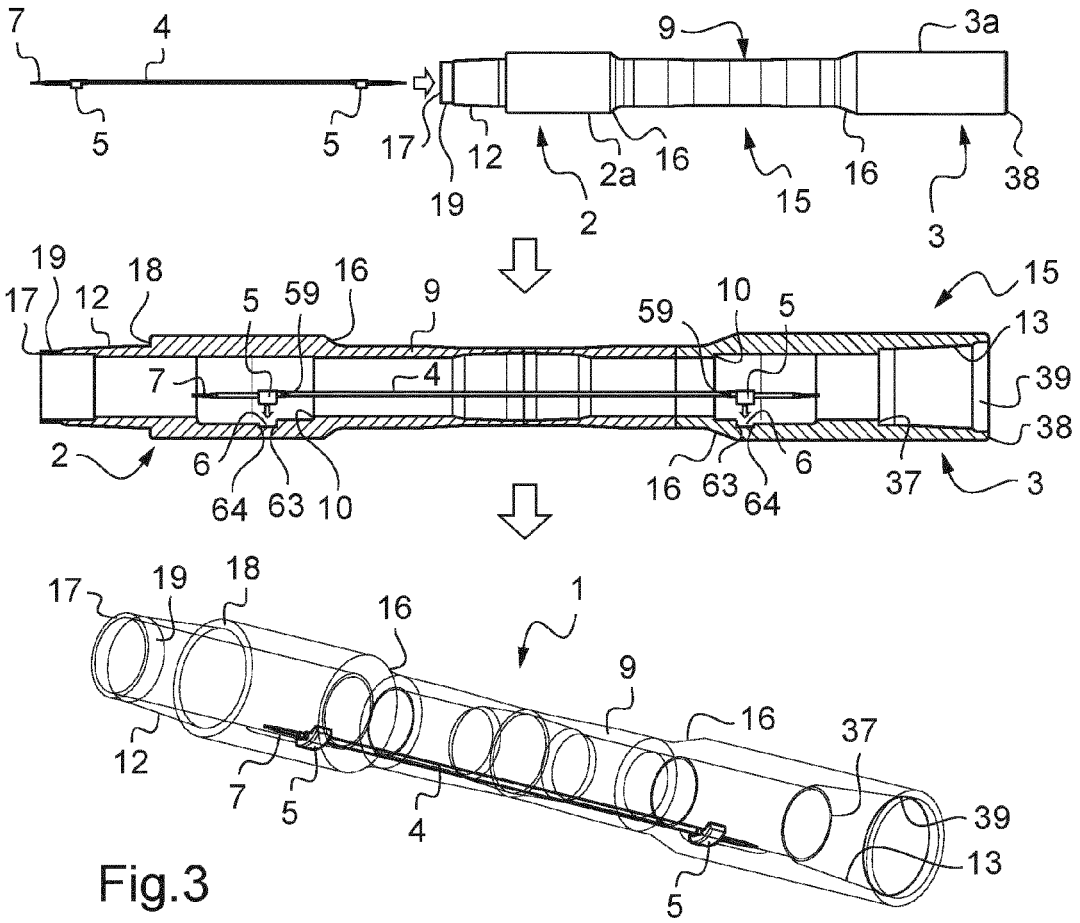
Figure 4:
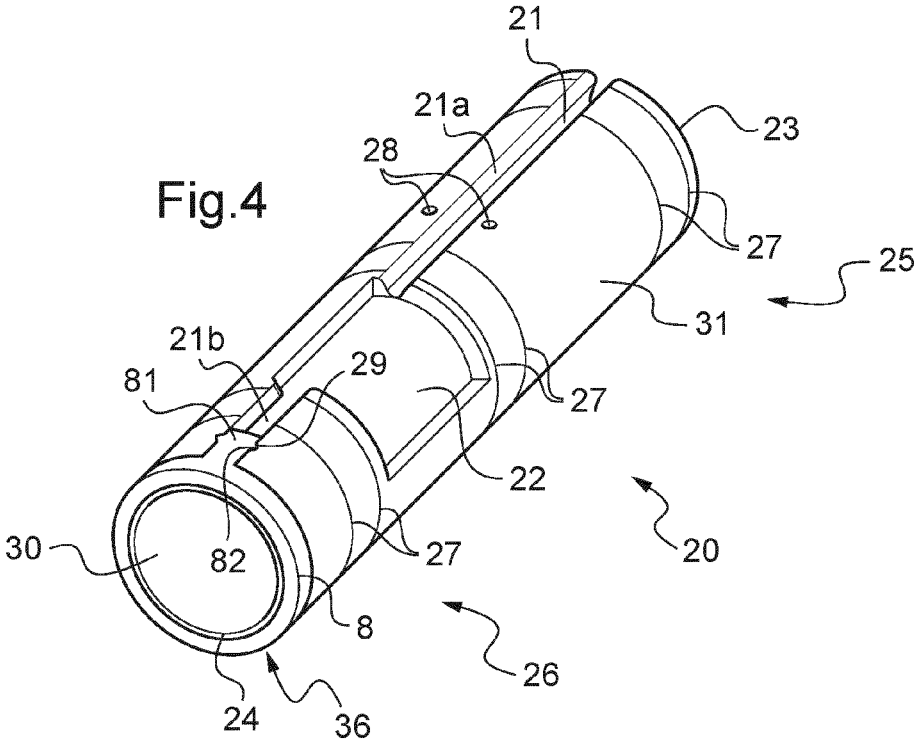
Figure 5:
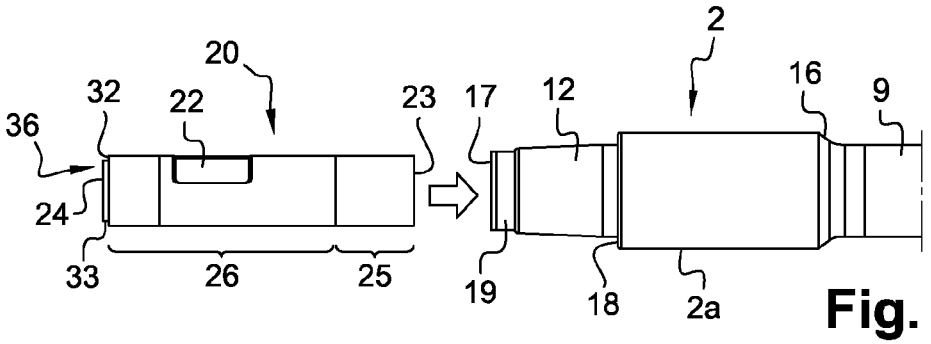
Figure 6A:
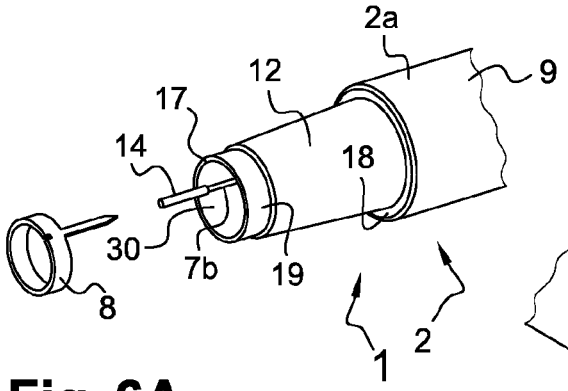
Figure 6B:
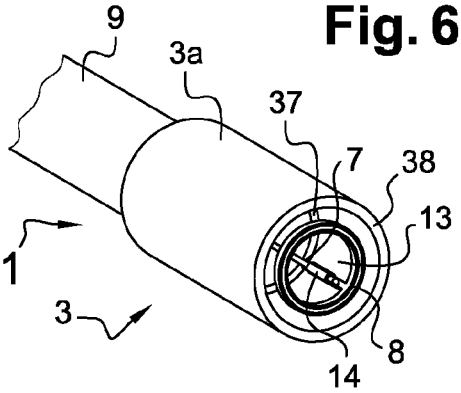
Figure 7:
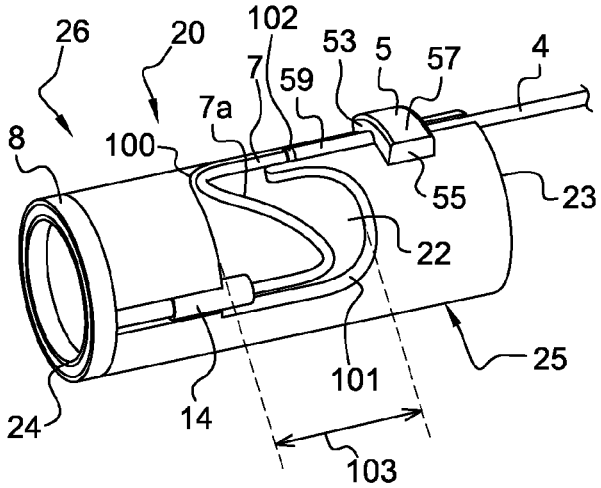
Figure 8:
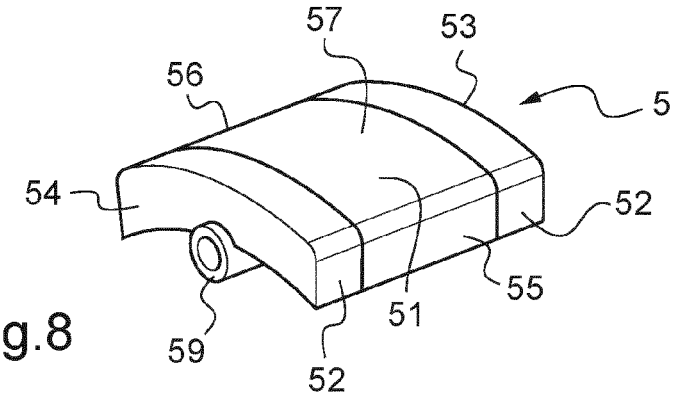
Figure 9:
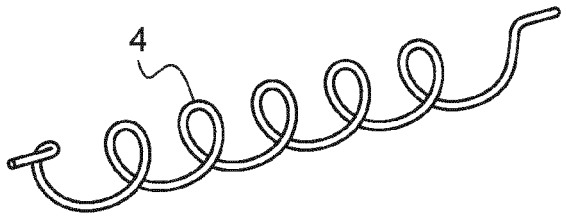
Figure 10:
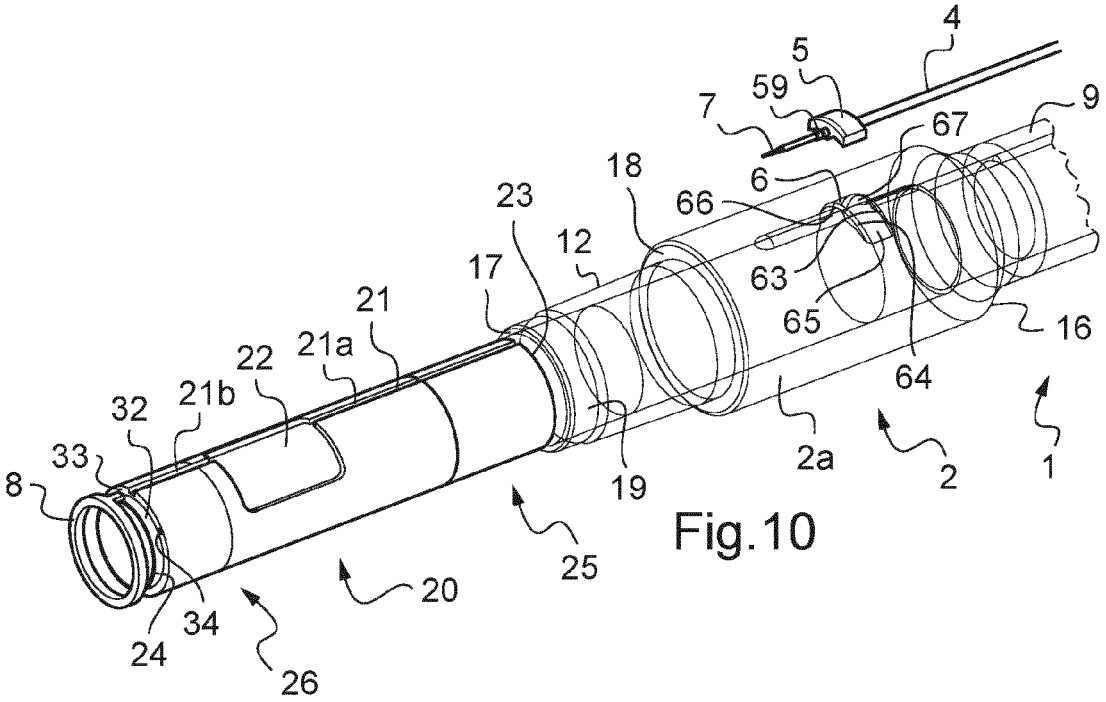
Figure 14:
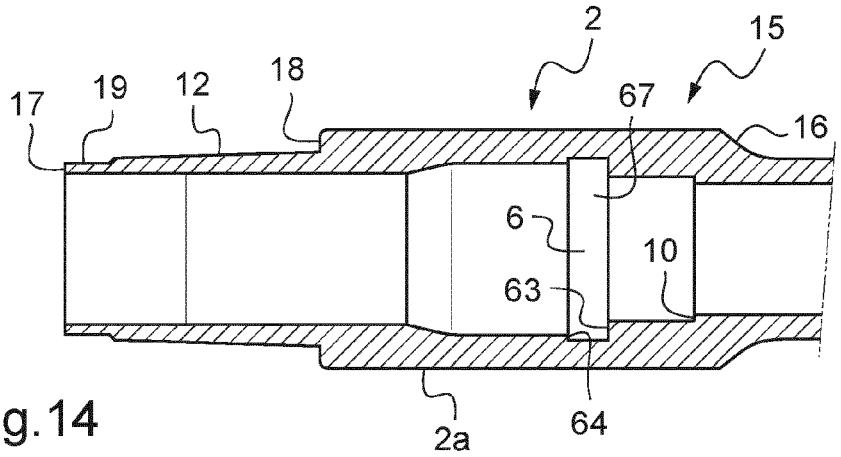
Figure 15:
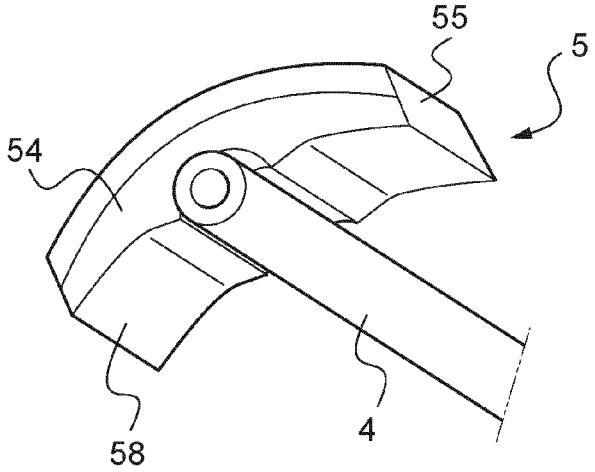
Figure 16:
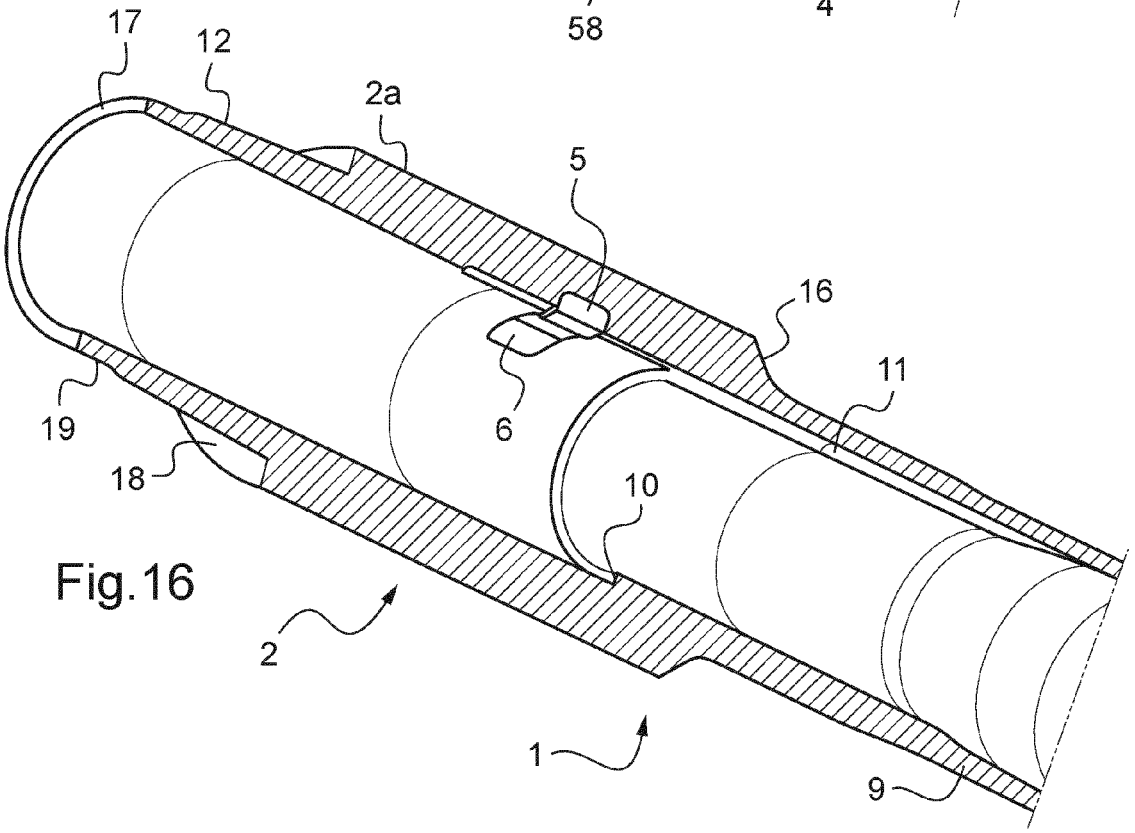

FIG. 3 diagrammatically illustrates the steps in mounting the device;

FIG. 4 is a perspective view of one embodiment of a transmission means mounted on a liner, the sheath, the cable and the lock having been omitted to render the drawing easier to read;

FIG. 5 shows the insertion of the liner into one of the end zones of the tubular component;

FIGS. 6A and 6B show the connection of a transmission means for the end zones; the liner has not been shown to make it easier to read;

FIG. 7 is a diagrammatic perspective view of the device in the mounted state; the first end zone has not been shown;

FIG. 8 is a detailed view of a lock provided with elastic elements;

FIG. 9 is a view of the helical sheath;

FIG. 10 is an exploded perspective view of an end zone, the first end zone having been made transparent;

FIG. 11 is a diagrammatic illustration of the component in a longitudinal sectional view in perspective and in detail and in which the sheath and the cable have not been shown;

FIG. 12 is a detailed view of FIG. 11;

FIG. 13 is a diagrammatic view of the operation of a lock provided with elastic elements;

FIG. 14 is a detailed sectional view of a component;

FIG. 15 is a detailed perspective view of the sheath associated with a lock;

FIG. 16 is a detailed perspective sectional view of a component provided with a lock;

FIGS. 17A and 17B are detailed perspective views of an embodiment of the liner provided with a housing;

FIG. 18 is a diagrammatic view of a sheath;

FIGS. 19A to 19C diagrammatically illustrate steps in machining a liner.

The accompanying drawings are at least partially specific in nature and may not only serve to complete the invention, but also to contribute to the definition if necessary.

A drill stem may comprise a plurality of pipes, especially standard pipes obtained by coupling, by welding, a male end zone of a great length tube and a female end zone on the side opposite to the male end zone in order to form leak-proof threaded tubular connections by coupling, and possibly heavy weight pipes. A pipe may be of any type from several that comply with specification API 7 from the American Petroleum Institute or the manufacturer's own designs. The drill string may be of the type described in documents U.S. Pat. No. 6,670,880, U.S. Pat. No. 6,717,501, US 2005/0115717, US 2005/0092499, US 2006/0225926, FR 2 883 915, FR 2 936 554 or FR 2 940 816.

The term "substantially" as used below takes into account the usual tolerances in the technical field under consideration.

The male end zone of the drill string comprises a male threading provided on an external surface, for example substantially tapered. The male end zone also comprises a bore, an external surface, an annular surface, for example substantially radial, between the male threading and the external surface, and an end surface, for example substantially radial. The bore and the external surface may be cylindrical bodies of revolution and be concentric. The male end zone connects to the tubular body or central portion via a substantially tapered internal surface and a substantially tapered external surface. The bore of the central portion may have a diameter which is greater than the diameter of the bore of the male section and the female section. The external diameter of the central portion may be less than the diameter of the external face of the male end zone and of the female end zone. The female end zone comprises internal surfaces which are at least partially complementary to the surfaces of the male end zone for make up with a similar male end zone of another tubular drill stem component.

When digging a well, a drill stem is suspended in the well. The drill stem is composed of tubular components coupled together one after the other and comprises a downhole assembly. A component may include measurement sensors, measuring the pressure, temperature, stress, inclination, resistivity, etc., for example. The drill stem may comprise standard length tubes, for example 10 meters in length, and instrumentation components.

A plurality of transmission means (or couplers) may be interconnected inside the drill stem to form a communication line, see U.S. Pat. No. 6,641,434. The two end zones of a drilling component are each equipped with a transmission means. The two transmission means of a component are connected via a cable, substantially over the length of the component. The cable is disposed in a protective sheath or tube, the ensemble being termed a communication line. The communication line is generally inserted into a hole provided in the thickness of the end zones of the component. In a central portion of the component, the communication line is disposed in the bore of said component due to the smaller thickness of the wall of the central portion compared with the thickness of the wall of the end zones.

The device does away with a longitudinal hole provided in the thickness of the end zones and avoids the mechanical weakening caused by such a hole. The device does away with the compromise between the mechanical strength of the end zones and the passage of a cable via the end zones. The device does away with creating a mouth for said longitudinal hole in a radial interference fitting surface, which limits the influence of the device on the seal of the junction between two components.

The device comprises a drill stem component which can transmit data in a reliable manner over time and over the length of the drill stem, while allowing the component to be re-used. The sheath which is fixed with respect to one end zone of the drill stem component is improved, wear is reduced, especially under intense mechanical loads on the drill stem, especially in tension, compression, torsion and/or buckling, under varied internal and external pressures, varied temperatures, vibrations and shocks.

The device may be adapted to existing tubular components by modifying them during maintenance.

Providing a housing in zones which are not mechanically critical for the primary tube means that expensive certification and/or compliance tests can be dispensed with. As an example, the integrity of the sealing surfaces is preserved.

Figure 1A:
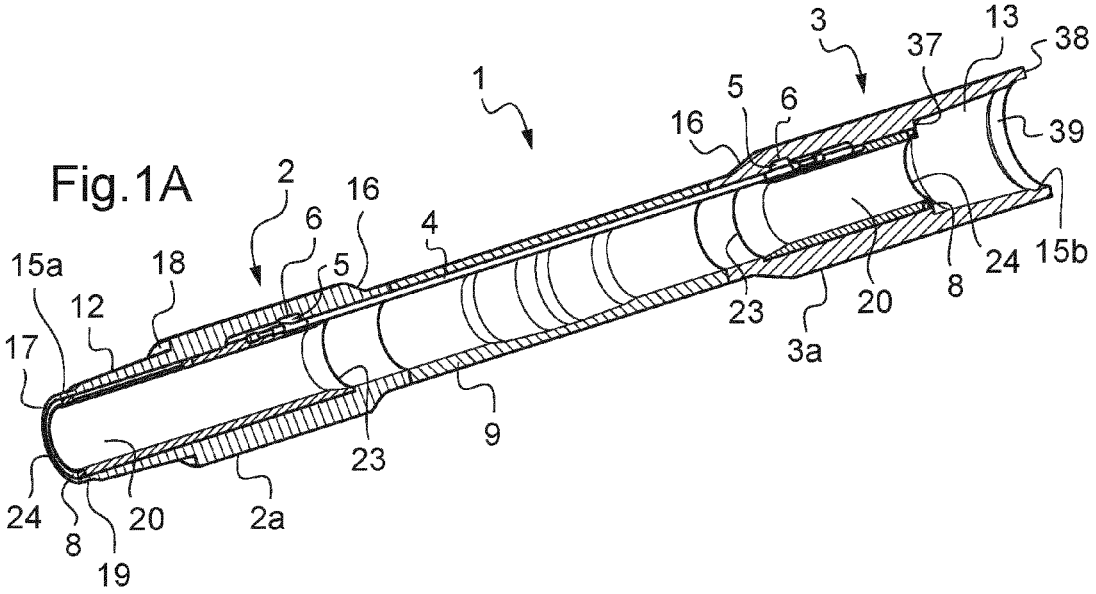
FIG. 1A is a diagrammatic longitudinal sectional perspective view of a component.

The tubular component 1 of the drill stem comprises a first end zone 2, a second end zone 3, a central portion 9 and in one embodiment at least one housing 6, see FIG. 1A. The sub-assembly formed by the end zones 2, 3, the central portion 9 and the housing 6 in this case is termed the primary tube 15. The tubular component 1 of the drill stem comprises a sheath 4, a lock 5 and a liner 20 in addition to the primary tube 15. The structure and material of the primary tube 15 are fluid-tight. In FIG. 1A, the first end zone 2 is male and the second end zone 3 is female. The first end zone 2 may be female. The second end zone 3 may be male. The second end zone 3 may have no liner and lock.

Said central portion 9 is elongate in form over a length of 5 to 15 meters for long components, for example a drill string, and 1 to 5 meters for short components, for example wear inserts used at well heads. The internal diameter and the external diameter may vary or be constant along the principal axial direction. The thicknesses may vary. The bore may be constant. The internal diameter may, for example, be 50 to 400 mm and the external diameter may be 100 to 500 mm.

The central portion 9 is formed from steel. The central portion 9 may comprise an aluminium alloy, a titanium alloy or a composite comprising a polymer filled with reinforcing fibres. The central portion 9 may be a tube obtained by a continuous casting technique. The primary tube 15 may be the result of friction welding each of the end zones 2, 3 either side of the tube forming the central portion 9. The ends of the central portion 9 may be thickened in order to increase the radial welding surface. Said thickening may be carried out at the external side of the wall forming the central portion 9, leaving a constant diameter bore.

The housing 6 may be obtained by machining an end zone before or after welding with the central portion 9. Here, the first end zone 2 is male and the second end zone 3 is female. The device may comprise a single liner 20 located in the first end zone 2 or the second end zone 3 or a liner 20 at each of said end zones 2, 3. A sheath 4 may be common to two locks 5 and two liners 20 may each be disposed in a respective end zone 2, 3.

In the embodiments shown in the figures, the primary tubes 15 are of a type comprising a male end and a female end. This is suitable for coupling a drill stem comprising a succession of components of the "male-female" or "integral" type. In another embodiment, the primary tubes 15 may be two distinct types coupled alternately and repetitively along a drill stem, one component comprising two male ends, then a coupling comprising two female ends. This is suitable for coupling a drill stem comprising a succession of components of the "male-male" and "female-female" type.

The end zones 2, 3 are formed from steel. The first and second end zones 2, 3 are generally tubular in shape. The first and second end zones 2, 3 are generally fixed either side of the central portion 9. Said end zones 2, 3 generally have an external diameter which is greater than that of the central portion 9 by 100% to 150%, for example. Said end zones 2, 3 generally have an internal diameter which is smaller than that of the central portion 9, for example 80% to less than 100%. The external surfaces 2*a*, 3*a* of the end zones 2, 3 comprise a tapered shoulder 16, see FIGS. 1A and 1B. The tapered shoulder 16 is located axially on the side of the central portion 9. The tapered shoulder 16 is located between the large diameter external surface 2*a*, 3*a* of the end zone 2, 3 and the small diameter external surface of the central portion 9. A shoulder 10 may be located in the bore of an end zone 2, 3. The thickness of the wall constituting the end zones 2, 3 is generally substantially greater than that of the wall constituting the central portion 9. This excess thickness means that supplemental machining can be carried out. In a variation, the internal diameter of the end zones 2, 3 may be slightly greater than that of the central portion 9, see FIGS. 1A, 1B and 3. In this case, the circumferential shoulder 10 has a surface directed in the direction opposite to the central portion 9.

The male end zone 2 comprises a male threading 12 on the side axially opposed to the central portion 9. The female end zone 3 comprises a female threading 13 on the side axially opposed to the central portion 9.

In the next paragraph, the terms "small" and "large" are relative values. The male/female end zones 2, 3, and more particularly their male/female threadings 12, 13, are adapted to interact by makeup with a female/male end zone 3, 2 of a compatible tubular component intended to be fixed to the first component 1 to form a drill stem. The male/female end zone 2, 3 generally comprises a small diameter annular surface 17, respectively 37, that can interact with another small diameter annular surface 37, 17 included in said corresponding female/male end zone of the complementary second tubular component 1, for example to stop makeup. The small diameter annular surfaces 17, 37 of the end zones 2, 3 are substantially perpendicular to the principal axis of the primary tube 15. The small diameter annular surface 17, in this case the male end zone, is disposed between an external surface 15*a* of the primary tube 15 and the axial end of the bore of the primary tube 15. The small diameter annular surface 37, in this case the female end zone, is disposed between the other axial end of the bore of the primary tube 15 and the female threading 13. The male/female end zone 2, 3 generally comprises a large diameter annular surface 18, respectively 38, which can interact with another large diameter annular surface 38, 18 comprised in said corresponding female/male end zone 3,2 of the complementary second tubular component 1, for example to stop makeup. The large diameter annular surfaces 18, 38 of the end zones 2, 3 are substantially perpendicular to the principal axis of the primary tube 15. The large diameter annular surface 18, in this case the male end zone, is disposed between the external surface 2*a* and the male threading 12. The large diameter annular surface 38, in this case the female end zone, is disposed between the external surface 3*a* and an internal surface 15*b* of the primary tube 15. The small and large diameter annular surfaces 17, 18, 37 and/or 38 may be sealing surfaces. In the end zone 2, the male threading 12 is disposed between the small diameter annular surface 17 and the large diameter annular surface 18. In the end zone 3, the female threading 13 is disposed between the small diameter annular surface 37 and the large diameter annular surface 38. Said annular surfaces 17, 18, 37, 38 may be separated from said threadings 12, 13 by an intermediate non-threaded surface, for example a lip 19, respectively 39.

Figure 1B:
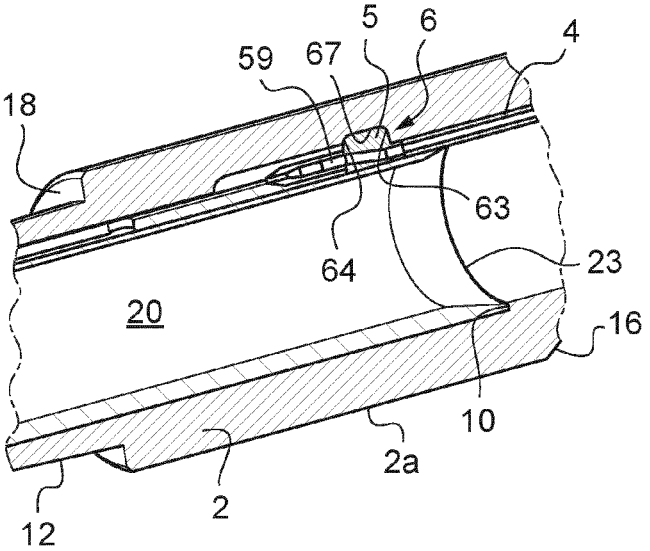
FIG. 1B is a detailed view of FIG. 1A.

In one embodiment, the housing 6 is disposed in the first end zone 2, see FIGS. 1B and 10. The housing 6 is provided from the bore of the first end zone 2. The housing 6 is located in the thickness of the wall of the first end zone 2. The housing 6 is concave. The housing 6 is defined axially in the primary tube 15 by facing substantially radial surfaces 63, 64. The housing 6 comprises a bottom surface 67. The housing 6 may be limited to an angular portion of the first end zone 2 by borders 65, 66. The borders 65, 66 are located between the bottom surface 67 and the bore of the primary tube 15 either side of the bottom surface 67. The borders 65, 66 in this case are in the extension of the bottom surface 67. The bottom surface 67 may be formed as a circular arc with its centre offset from the general axis. The bottom surface 67 and the borders 65, 66 in this case are in the form of a circular arc in a radial plane, see FIG. 10.

In a variation, the borders 65, 66 may comprise two surfaces contained in planes comprising the principal axis of the primary tube 15. The borders 65, 66 may be substantially perpendicular to the bottom surface 67.

In another variation, the housing 6 may have a generally annular shape in the bore of the first end zone 2, see FIG. 14. The bottom surface 67 has an annular shape which is concentric with the bore of the primary tube 15. The bottom 67 is at a distance from the bore of the primary tube 15. The housing 6 may be an axially limited concave region and with a diameter which is enlarged with respect to the bore of the first end zone 2.

Figure 2:
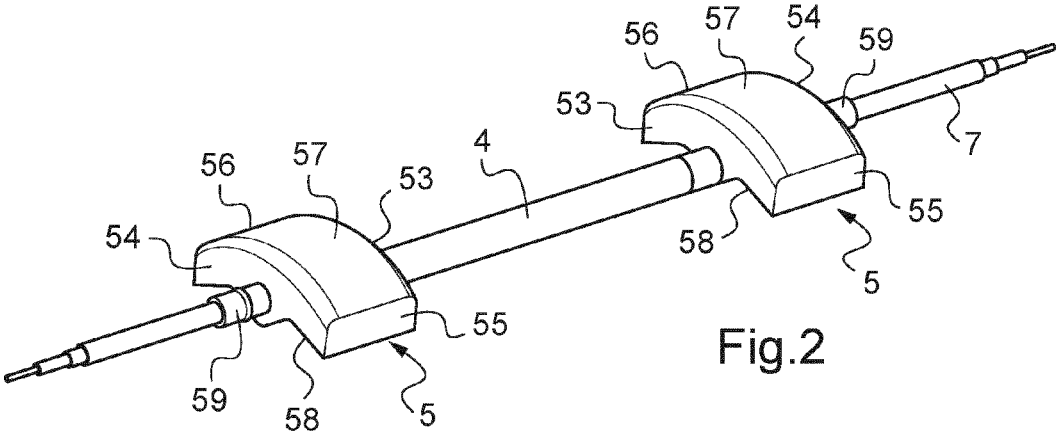
FIG. 2 is a detailed perspective view of the sheath associated with two locks.

The sheath 4 is generally tubular in shape, see FIGS. 1A and 2. The internal diameter is selected so as to be substantially larger than the diameter of a cable 7 intended to be housed in the sheath 4. The thickness of the wall forming the sheath 4 is adapted to resist mechanical stresses to which the sheath 4 is subjected in operation. The length of the sheath 4 is selected so that in the mounted state, the sheath 4 extends at least from the first end zone 2 to the second end zone 3 of the component 1. The sheath 4 may be longitudinal, see FIGS. 1A, 2 and 3. The sheath 4 may be partially helical in shape, see FIGS. 9, 17A and 17B. The sheath 4 may be produced from metal, for example a nickel-iron-chromium alloy, for example Incoloy 825, or from stainless steel, for example AISI 316L. The sheath 4 may be manufactured from long profiles which are then cut to the desired length. In the mounted state, the sheath 4 extends from a first end zone 2 to a second end zone 3. The sheath does not have to be stretched between the end zones 2 and 3. The sheath 4 is flush against the bore of the central portion 9.

In an embodiment shown in FIG. 18, the sheath 4 may be highly elastic. The sheath 4 comprises several layers of metallic braiding, or mesh 70 to 73 disposed between an internal layer 74 and an external layer 75. The external layer 75 is selected to resist abrasion by drilling mud. The external layer 75 is fluid-tight. The internal layer 74 is fluid-tight. The internal layer 74 advantageously comprises a polymer. The external layer 75 may advantageously comprise an elastomer. The layers of metallic braiding 70 to 73 may be separated by at least one intermediate layer 76 of elastomer. Each of the internal layer 74, metallic braiding 73, 72, intermediate layer 76, metallic braiding 71, 70 and external layer 75 is tubular. Each of said layers is disposed around another in that order from the interior to the exterior. The sheath 4 is substantially straight. For mounting, dismantling or maintenance, the device can be taken out of the component by pulling on the elastic sheath 4.

The sheath 4 and cable 7 may be produced from a unitary sub-assembly. Electrical conduction may then be provided by the layers of metallic braiding 70 to 73. Mechanical and chemical protection may then be provided by the external layer 75. Said sub-assembly may comprise a coaxial cable.

The lock 5 or anchor point or anchor may comprise a body 51, see FIG. 8. The body 51 may be produced by moulding and/or machining a metal, for example a nickel-iron-chromium alloy, for example Incoloy 718. The lock 5 may have the general shape of a polyhedron, for example a hexahedron, comprising six surfaces 53 to 58, see FIG. 2. The lock 5 is intended to be placed in the housing 6. The lock 5 in this case comprises a tube portion 59 integral with the body 51. The tube portion 59 may be configured to allow a cable 7 to be passed through and protrude from the sheath 4 in the mounted state. In the mounted state the tube portion 59 is aligned with the sheath 4. The tube portion 59 of the lock 5 means that shear of the cable 7 by slight movements or vibrations in operation between the lock 5 and the liner 20 can be avoided. In a variation, in the mounted state the sheath 4 is disposed through the lock 5 in the tube portion 59. The sheath 4 is then axially either side of the lock 5. In the embodiment of FIG. 15, the sheath 4 fits into a longitudinal groove of the lock 5. The sheath 4 and the lock 5 may be fixed together, for example by welding.

The lock 5 comprises two opposed substantially radial surfaces 53, 54 axially defining the lock 5. In the mounted state, the substantially radial surfaces 53, 54 of the lock 5 cooperate by respective surface interference with the substantially radial surfaces 63, 64 of the housing 6. In the mounted state, said surface interferences 53, 63, 54, 64 can clamp displacement of the lock 5 in the axial direction of the primary tube 15. The substantially radial surfaces 53, 54 may be parallel.

The lock 5 comprises two opposed border surfaces 55, 56 angularly defining the lock 5 in the primary tube 15. In this case, in the mounted state, the border surfaces 55, 56 of the lock 5 cooperate by respective surface interference with the borders 65, 66 of the housing 6. In the mounted state, displacement of the lock 5 in the circumferential direction of the primary tube 15 is blocked. The border surfaces 55, 56 may be parallel.

The lock 5 comprises an upper curved surface 57, which is convex in this case, defining the lock 5 in the radial direction of the primary tube 15. In the mounted state, the upper curved surface 57 of the lock 5 interferes with the bottom surface 67 of the housing 6. In the mounted state, said interference of the upper curved surface 57 and bottom surface 67 can clamp displacement of the lock 5 in the radial direction of the primary tube 15 in the direction from the interior to the exterior of the primary tube 15.

The lock 5 comprises a lower curved surface 58, which is concave in this case. The lower curved surface 58 of the lock 5 is substantially aligned with the bore of the primary tube 15, in the mounted state.

In a variation, the upper curved 57 and lower curved 58 surfaces may be parallel.

In the variation with an annular housing 6, the lock 5 may be free in the circumferential direction of the primary tube 15.

A combination of the variation having the annular housing 6 with the variation having the sheath 4 in the partially helical form is possible. Said combination, in the absence of angular indexing of the sheath 4 in the primary tube 15, allows the pitch of the helix formed by the sheath 4 in the primary tube 15 to be selected, at the time of mounting. The operator can adjust the pitch of the helix by displacing the lock 5 fixed to the sheath 4 in the circumferential housing 6, for example by rotating the liner 20.

The body 51 of the lock 5 may comprise at least one elastic element 52, see FIGS. 8 and 13. Said elastic element 52 may, for example, be composed of elastomeric material so as to reduce the stresses to which said lock 5 is subjected in operation. Said elastic element 52 may be composed of several layers of materials that can cause anisotropic mechanical behaviour of the elastic element 52 (see FIG. 13). The elastic element 52 may be in contact with the sheath 4 so as to allow a slight elastic movement between the sheath 4 and the lock 5. The elastic element 52 may be in contact with the housing 6 so as to allow a slight elastic movement of the lock 5 in the housing 6. The substantially radial surface 53 may belong to the elastic element 52, see FIG. 8. The substantially radial surface 54 may belong to the elastic element 52, see FIG. 8. The elastic element 52 provides greater dimensional manufacturing tolerance for the lock 5 and for the housing 6 by limiting the consequences of a slight mobility of the lock 5 in its housing 6. Because of the elastic element 52, slight shocks on the lock 5 in the housing 6 are better absorbed.

The lock 5 is fixed to one end of the sheath 4, see FIG. 2. The sheath 4 and the lock 5 in this case are welded together. The tube portion 59 is aligned with the bore of the sheath 4. The passage for the cable 7 is continuous between the sheath 4 and the lock 5. In the mounted position, the cable 7 passes through both the sheath 4 and the lock 5. Said lock 5 is inserted in the housing 6, see FIGS. 3 and 10. The orientation of the lock 5 in the housing 6 is such that interference of the surfaces described above is possible.

In accordance with another embodiment, the lock 5 may be obtained by mechanical deformation of the sheath 4 so as to produce a thickening thereof. In this case, the sheath 4 and the lock 5 form a unitary part.

In accordance with another embodiment, not shown, the lock 5 comprises a body of revolution, substantially fixed in translation, about the sheath 4. The body of revolution may have the form of a ring for the sheath 4. The link between the sheath 4 and the lock 5 may be of the pivot pin type. Rotation of the lock 5 about the axis of the sheath 4 and with respect to said sheath 4 is possible.

The liner 20 comprises steel, or any other material that has similar mechanical properties. The liner 20 is a part with a generally tubular shape, see FIG. 4. The liner 20 is provided for positioning in the bore of the first end zone 2, see FIGS. 1A, 3 and 5. The liner 20 has a length of the order of the length of the end zone 2. The liner 20 comprises an internal surface 30 (or bore) and an external surface 31. The liner 20 comprises a head terminal surface 23 and a tail terminal surface 24. The head 23 and tail 24 terminal surfaces may be annular. The distance between the head terminal surface 23 and the tail terminal surface 24 determines the length of the liner 20. The material and structure of the liner 20 may be fluid-tight.

In the mounted state, the head terminal surface 23 is located axially on the side of the central portion 9 of the primary tube 15. In the mounted state, the tail terminal surface 24 is located axially on the side opposite to the central portion 9 of the primary tube 15. In the mounted state, the tail terminal surface 24 is located axially in the vicinity of the small diameter annular surface 17 of the first end zone 2. In other words, in the case of a male first end zone 2, the tail terminal surface 24 may be located flush with or slightly set back from the axial limit of the primary tube 15. In the case in which the first end zone 2 is female, the tail terminal surface 24 is located axially in the vicinity of the small diameter annular surface 37. The tail terminal surface 24 may be located flush with or slightly set back from the female threading 13 on the side of the central portion 9, see FIG. 1A. The flush fitting or slight setback of the tail terminal surface 24 with respect to the small diameter annular surface 17, 37 of the primary tube 15 may constitute an axial indexing.

In the embodiment represented in FIG. 1B, the primary tube 15 comprises a shoulder 10. In the mounted state, the head terminal surface 23 interferes with the shoulder 10 of the bore of the first end zone 2. Contact of the shoulder 10 and the head terminal surface 23 may constitute an axial indexing.

In a variation, the primary tube 15 has no shoulder 10. In a variation, the primary tube 15 is the constant diameter bore. In a variation, the primary tube 15 is a smooth bore. In these three cases and their combinations, axial indexing of the tail terminal surface 24 is sufficient. The shoulder 10 may be substantially tapered.

In order to facilitate flow of fluids inside the tubular component 1, variations in the diameter of the internal surface 30 of the liner 20 and the bore of the tubular component 1 are small, see FIG. 1A. A portion of the internal surface 30 of the liner 20 located in the vicinity of the head terminal surface 23 in this case has an increasing diameter in the direction of the central portion 9. In other words, the external diameter of the liner 20 is set so as to correspond to the bore of the primary tube 15; the thickness of the wall of the liner decreases in the direction of the central portion 9 of the primary tube 15. This adaptation facilitates the flow of fluids inside the tubular component 1 via the liner 20. The internal surface 30 of the liner 20 may be of constant diameter and/or be smooth. In the case of a primary tube 15 with no shoulder 10, the axial limit of the side of the head terminal surface 23 of the liner 20 tends towards a zero wall thickness, within machining limits. In a variation, the bore of the liner 20 may comprise a local boss protecting the passage of the sheath 4. The boss can protect the sheath 4 while optimizing fluid flow.

The external surface 31 of the liner 20 in this case comprises a guide portion 25 and a fixing portion 26, see FIG. 5. The guide portion 25 has an external diameter which is substantially smaller, for example by 1% to 5%, than the internal diameter (bore) of the first end zone 2. The guide portion 25 is located axially on the side of the head terminal surface 23. The guide portion 25 facilitates positioning of the liner 20 in the bore of the first end zone 2, especially when the liner 20 is not perfectly aligned with the principal axis of the primary tube 15 upon insertion into said liner 20. The fixing portion 26 of the liner 20 has an external diameter substantially adjusted for force fitting by surface interference between the external surface 31 of the liner 20 and the bore of the first end zone 2. The fixing portion 26 holds the liner 20 in its mounted position by contact. The liner 20 may be force fitted. The liner 20 may be hooped. The liner 20 may be bonded at least in part to the bore of the first end zone 2. The liner 20 may comprise several distinct fixing portions 26.

The liner 20 comprises an elongate channel 21, see FIG. 4. The elongate channel 21 in this case extends from the head terminal surface 23 to the tail terminal surface 24. The elongate channel 21 opens into the head terminal surface 23 on the one hand and into the tail terminal surface 24 on the other hand. The elongate channel 21 is adapted to constitute a passage for the sheath 4 in the mounted state. The elongate channel 21 in this case is an elongate groove provided from the external surface 31 of the liner 20. The elongate channel 21 is substantially parallel to the principal axis of the primary tube 15. In a variation, the elongate channel 21 may comprise a portion included in the thickness of the wall of the liner 20, see FIGS. 17A, 17B and 19A to 19C. Said portion of the elongate channel 21 takes the form of a longitudinal through hole. The term "channel" may in this case denote an open or closed space. In the case of an elongate channel 21 having the shape of a groove in the external surface of the liner 20, the bore of the end zone may comprise an elongate groove substantially facing the elongate channel 21 that can partially house the sheath 4.

The wall of the liner 20 in this case comprises substantially radial through holes 28 located in the vicinity of the elongate channel 21. The holes 28 may have a substantially tapered bore. The holes 28 are intended for the passage of filling fluid. The filling fluid may be grease, for example. The filling fluid has viscous properties which are substantially constant over time. Said filling fluid may be injected via the elongate channel 21 from the tail surface 24. Said filling fluid may be injected via the holes 28 from the bore 30 of the liner 20. During insertion of the filling fluid, overflow via the elongate channel 21 or the holes 28 may be an indicator of satisfactory filling. Said filling fluid may facilitate mobility of the sheath 4 in the elongate channel 21, for example by also possessing lubricating properties. Said filling fluid occupies empty spaces such as the interstices of the device not intended for the passage of drilling mud. Occupying the empty spaces means that intrusion of drilling mud, which could damage the integrity of the device, can be limited. In fact, drilling mud may be chemically aggressive, oxidizing, abrasive and capable of hardening. Said filling fluid does not harden. The filling fluid in this case fills. The filling fluid encourages electrical isolation of the cable 7 from the drilling mud. Said filling fluid may facilitate, by fluid communication, iso-pressure of each side of the wall of the liner 20. Said iso-pressure reduces the risks and magnitude of deformations of the liner 20. In this case, the filling fluid is inserted after mounting the liner 20, after cabling and before installation of a transmission means 8.

The external surface 31 of the liner 20 in this case comprises serrations 27 disposed in radial planes, bolstering bonding of the liner 20 in the first end zone 2.

In accordance with another embodiment represented in FIGS. 17A and 17B, the lock 5 comprises a staple, for example U-shaped. The end of the sheath 4 comprises an axially delimited reduction in the external diameter, for example an external annular groove 4*a*. The shapes of the annular groove 4*a* of the sheath 4 and the lock 5 match, bringing about axial clamping. In the mounted state, the lock 5 is partially disposed in said annular groove 4*a* of the sheath 4. Translation of the sheath 4 with respect to the lock 5 is prevented by the interaction of surfaces. The ends of the arms 5*a* and 5*b* of the lock 5 are installed in corresponding cavities 6*a* and 6*b* provided in the thickness of the liner 20, from the external surface 31 of the liner 20. The housing 6 in this case is disposed in the liner 20. The housing 6 comprises cavities 6*a* and 6*b*. Machining the housing 6 into the primary tube 15 is simplified. The liner 20 radially and axially clamps the lock 5. The axial clamping of the sheath 4 and lock 5 assembly in this case is provided by the liner 20. Axial displacement of the lock 5 is blocked by the housing 6 included in the liner 20. Radial displacement of the lock 5 in the exterior to interior direction of the component 1 is blocked by the housing 6 included in the liner 20. Radial displacement of the lock 5 in the direction from the interior to the exterior of the component 1 is blocked by the bore of the first end zone 2.

As can be seen in FIGS. 4, 5, 7, 10, 17B and 19A to 19C, the liner 20 may comprise at least one take-up chamber 22. The take-up chamber 22 is disposed along the elongate channel 21. The take-up chamber 22 is at an axial distance from the head terminal surface 23. The take-up chamber 22 is at an axial distance from the tail terminal surface 24. The take-up chamber 22 in this case has the shape of a hollow, or of a reduction in the thickness of the wall from the external surface 31 of the liner 20. The radial dimension of the take-up chamber 22 is strictly less than the thickness of the wall of the liner 20. The radial dimension of the take-up chamber 22 may be constant. The radial dimension of the take-up chamber is greater than the diameter of the cable which will be introduced into it, for example about 1.5 times greater. The take-up chamber 22 may be axially delimited by two substantially radial surfaces, see FIG. 4. The take-up chamber 22 may be axially delimited by two substantially concave surfaces, see FIG. 7. The take-up chamber 22 may be angularly delimited, along the principal axis of the liner 20, by two substantially planar surfaces parallel to the principal axis, see FIGS. 4 and 7. The take-up chamber 22 may be angularly delimited, along the principal axis of the liner 20, by two substantially concave surfaces.

In a variation, the take-up chamber 22 may consist of an annular groove coming from the external surface 31 of the liner 20 over an axially limited portion.

The take-up chamber 22 may consist of a circumferential enlargement of the elongate channel 21.

In this case, the elongate channel 21 comprises two elongate channel portions 21*a*, 21*b*, see FIGS. 4, 7, 17B, and 19A to 19C. The elongate channel portions 21*a*, 21*b* are substantially parallel to the principal axis of the component 1. The first elongate channel portion 21*a* is disposed axially between the take-up chamber 22 and the head terminal surface 23 of the liner 20. The first elongate channel portion 21*a* opens into the head terminal surface 23. The first elongate channel portion 21*a* opens into the take-up chamber 22. The second elongate channel portion 21*b* is disposed axially between the take-up chamber 22 and the tail terminal surface 24 of the liner 20. The second elongate channel portion 21*b* opens into the tail terminal surface 24. The second elongate channel portion 21*b* opens into the take-up chamber 22. The two elongate channel portions 21*a*, 21*b* have the same characteristics as the elongate channel 21 described above, with the exception of the positioning of their mouths. The two elongate channel portions 21*a*, 21*b* may be aligned, see FIG. 4.

The two elongate channel portions 21*a*, 21*b* may be offset in the circumference of the liner 20, see FIG. 7 and FIGS. 19*a* to 19*c*. In this embodiment, the elongate channel 21*a* opens into the take-up chamber 22 and this latter has an inwardly curved boundary 100 in the axis of the channel 21*a*. The inwardly curved boundary 100 connects an axially delimiting face to an angularly delimiting face of said take-up chamber. Such a configuration facilitates flexing of the cable when it is introduced into the take-up chamber into which the sheath opens. In a symmetrical manner, the take-up chamber 22 may comprise a second inwardly curved boundary 101 in the axis of the channel 21*b* to connect another face delimiting the chamber axially to another face which angularly delimits said chamber. The inwardly curved boundaries 100 and 101 have a radius of curvature which is greater than or equal to the minimum radius of curvature tolerated by the cable 7. Preferably, all of the edges defining the take-up chamber are rounded in order to prevent the cable from being snipped The liner 20 may also comprise a supplemental assembly comprising a supplemental take-up chamber 22 and a supplemental elongate channel 21 angularly offset with respect to the take-up chamber 22 and the elongate channel 21 described above. This means that the communication lines can be multiplied using a single liner 20. This embodiment may be selected when a small sheath diameter 4 is preferable to a single use for said sheath 4. The functions of the communication lines may thus be dissociated. As an example, a component 1 may comprise a liner 20 in each of its end zones 2 and 3 and two substantially diametrically opposed sheaths 4 disposed in the primary tubes 15. Each of the sheaths 4 may then be fixed by a lock 5 at each of its ends and each of the four locks 5 may be fixed at least radially by one of two liners 20.

The supplemental elongate channel 21 and the supplemental take-up chamber 22 may also house a battery, a repeater, a memory or other electronic or electrotechnical elements. The elements housed in the second take-up chamber 22 may be electrically isolated from other drilling components during function of the drill string. Said elements may be placed in electrical connection with external monitoring apparatus during maintenance operations.

The liner 20 may comprise a circumferential tail groove 36, see FIGS. 4, 5, 11 and 12. The circumferential tail groove 36 is defined by a supplemental radial or at least substantially radial surface 32 in the liner 20. The circumferential tail groove 36 is defined by a supplemental axial or at least substantially axial surface 33 in the liner 20.

The supplemental radial surface 32 is located in the vicinity of the tail terminal surface 24. The supplemental radial surface 32 is substantially parallel to the tail terminal surface 24. The supplemental radial surface 32 is annular. The supplemental radial surface 32 is radially located in a portion of the thickness of the wall of the liner 20. The supplemental radial surface 32 may be connected with the external surface 31 of the liner 20. In this case the circumferential tail groove 36 is radially open over the external surface 31. The supplemental radial surface 32 may be connected with the internal surface 30 of the liner 20. In this case, the circumferential tail groove 36 is radially open onto the internal surface 30.

The supplemental axial surface 33 is axially located between the tail terminal surface 24 and the supplemental radial surface 32. The supplemental axial surface 33 is radially located between the internal surface 30 and the external surface 31 of the liner 20. The supplemental axial surface 33 is annular. The supplemental axial surface 33 connects with the supplemental radial surface 32. The supplemental axial surface 33 connects with the tail terminal surface 24. The circumferential tail groove 36 is axially open onto the tail terminal surface 24.

In other words, the circumferential tail groove 36 corresponds to a reduction in the external diameter or an enlargement of the bore of a section of the liner 20 located axially on the side of the tail terminal surface 24.

The circumferential tail groove 36 is configured to house the transmission means 8.

The supplemental axial surface 33 in this case supports a rib 35, see FIGS. 11 and 12. The rib 35 is configured to project, in the mounted state, into a corresponding groove of the transmission means 8. The rib 35 is annular. The rib 35 can hold the transmission means 8 axially in the mounted state.

In a variation, the length of the liner 20 is selected so that in the mounted state, the tail surface 24 of said liner 20 is axially set back in the component 1 with respect to the small diameter annular surface 17 of the first end zone 2. The transmission means 8 may be disposed against the tail surface 24 of the liner 20. The transmission means 8 may be flush with a radial surface of the first end zone 2. In other words, said axial set back leaves a place for the transmission means 8 in the component 1. This configuration frees the tail surface 24 from having to be machined specifically for the transmission means 8. In the mounted state, the liner 20 and the transmission means 8 have substantially continuous internal and external surfaces.

Tapped holes 34 are located in the thickness of the wall of the liner 20, see FIG. 10. The tapped holes 34 are substantially parallel to the axis of the liner 20. The tapped holes 34 may be punched from the tail terminal surface 24. The tapped holes 34 may be punched from the supplemental radial surface 32. The tapped holes 34 are closed. There may be three tapped holes 34. The tapped holes 34 may be equidistant from each other. The tapped holes 34 are adapted to being screwed to a rotary machine that can remove the liner 20 from the component 1.

In the mounted state, the sheath 4 is surrounded by the elongate channel 21 of the liner 20. In the case of an elongate channel 21 having the form of an elongate groove provided from the external surface 31 of the liner 20, however, the sheath 4 is surrounded by the bore of the first end zone 2, see FIG. 7. The elongate channel 21 may have a constant section that matches the sheath 4. The elongate channel 21 clamps the sheath 4 in a selected angular space of the tubular component 1. The elongate channel 21 may be axially matched to the sheath 4 on the head terminal surface 23 side of the liner 20. Said adjustment means that displacement of the portion of the sheath 4 located in the central portion 9 of the component 1 in operation can be limited.

A supplemental groove 11 may be provided through the shoulder 10 of the bore of the primary tube 15, see FIG. 16. The supplemental groove 11 leaves a passage for the sheath 4 between the elongate channel 21 and the interior of the central portion 9 of the tubular component 1. Said supplemental groove 11 may be matched to the sheath 4 in order to limit displacement of the free portion of the sheath 4 located in the central portion 9 of the component 1 in operation. The sheath 4 is disposed in the liner 20 and does not protrude from the take-up chamber 22. Alternatively, the sheath 4 could partly protrude and ends into the take-up chamber. At least part of the cable 7 protruding from the sheath 4 extends into the take-up chamber 22.

As can be seen in FIG. 7, the cable 7 is provided on the outside with a retaining stopper 102 which can delimit the portion of the cable 7 protruding from the sheath 4 from the portion of the cable disposed in the sheath 4. The retaining stopper 102 is integral with the cable 7 and does not slide along the cable, and so the length of the cable 7 between the position of this retaining stopper 102 and the plug 14 can be controlled. This retaining stopper 102 forms, for example, a ring with an external diameter greater than the internal diameter of the sheath 4.

This length of cable 7 between the position of this retaining stopper 102 and the plug 14 is greater than the axial length determined between said retaining stopper 102 and the tail terminal surface 24. Thus, it is possible to define the length of an excess length 7*a* of cable as that corresponding to the length of cable that can protrude from this tail terminal surface 24. In the mounted state, this excess length 7*a* of cable is stored in the take-up chamber 22. This take-up chamber 22 has an axial length 103 which is at least twice, or even at least three times smaller than the excess length 7*a* of the cable.

In the mounted state, the take-up chamber 22 accommodates a reserve portion of cable 7 available for mounting and/or maintenance operations.

After mounting the liner 20, the take-up chamber 22 can be used to make available a length of cable 7 that is greater than that geometrically necessary to cable the component 1 over its length. Stored in the take-up chamber 22 in the mounted state, a supplemental portion 7*a*, or excess length 7*a*, of the cable 7 can, upon being deployed, provide a portion 7*b* of the cable 7 which protrudes out of the tail terminal surface 24 of the liner 20, see FIGS. 6A and 6B. This more easily accessible portion 7*b* of cable 7 means that, for example for connection, a plug 14 of the cable 7 located outside the tubular component 1 can be used. The cable connection 7 is retractable and may be inside the tubular component 1 in service, see FIG. 7. The supplemental portion 7*a* of cable 7 is stored in the take-up chamber 22, for example as a coil.

In one embodiment (not shown) comprising a flexible highly elastic sheath 4, the sheath 4 may house the entire length of the cable 7, and especially including that within the take-up chamber 22, following the curves of said cable 7. This is suitable when the sheath 4 and the cable 7 are in a single piece or when the sheath 4 is produced in accordance with the embodiment of FIG. 18.

In the mounted state and in the case in which housing 6 is included in the primary tube 15, a portion of the external surface 31 of the liner 20 is an interference fit with the lower curved surface 58 of the lock 5 disposed in the housing 6, see FIGS. 1A, 1B and 7. A surface of the lock 5 faces the external surface 31 of the liner 20. The interference fit of the lower curved 58 and external surfaces 31 means that displacement of the lock 5 in the radial direction of the primary tube 15 towards the interior of the primary tube 15 can be blocked. The lock 5 is thus clamped between the primary tube 15 and the liner 20. The liner 20 mechanically and radially clamps the lock 5 in the housing 6 so as to prevent displacement towards the central axis of the component 1 (see FIG. 1A). The liner 20 holds the lock 5 in the housing 6.

The sheath 4 may be angularly maintained with respect to the axis of the tubular component 1 by the liner 20. The sheath 4 may be angularly maintained with respect to the axis of the tubular component 1 by the lock 5.

In the case where the housing 6 is comprised in the primary tube 15, the liner 20 at least radially clamps the lock 5 in position. The liner 20 at least radially clamps the lock 5 with respect to the first end zone 2. The lock 5 is at least axially clamped by the housing 6 with respect to the first end zone 2. The sheath 4, clamped by the lock 5, is at least axially and radially clamped with respect to the liner 20 and the first end zone 2. In the embodiment in which the sheath 4 and the lock 5 are free to rotate with respect to each other, the sheath 4 remains free to rotate about its own axis. The elongate channel 21 of the liner 20 housing the sheath 4 clamps said sheath 4 in the circumferential direction of the tubular component 1. The sheath 4 may be free to rotate about its own axis but is held in the principal axis of the tubular component 1, once the liner 20 is mounted, to within the machining tolerances of the elongate channel 21. Fitting the elongate channel 21 to the sheath 4 means that the play allowed by the sheath 4 can be adjusted at the first end zone 2.

The tubular component may comprise the transmission means 8. The transmission means 8 may be of the electrical contact connector type. The transmission means 8 may be of the capacitive coupler type. The transmission means 8 may be of the inductive coupler type. In this case the transmission means 8 comprise an annular body which in the mounted state can be placed in the circumferential tail groove 36 of the liner 20. The transmission means 8 may comprise at least one holding means 81 which is in one piece with said annular body, see FIG. 4. The holding means 81 takes the form of a finger. The holding means 81 in this case projects into the elongate channel portion 21*b* of the liner 20. The positioning of the holding means 81 in the elongate channel portion 21*b* fixes the angular indexing of the transmission means 8. The holding means 81 in this case is provided with lugs 82. The lugs 82 project into radial grooves 29 provided in at least one surface of the elongate channel portion 21*b*. Co-operation of said lugs 82 and said radial grooves 29 ensures axial clamping of the transmission means 8 with respect to the liner 20. The transmission means 8 may comprise several holding means 81. The liner 20 comprises at least as many recesses corresponding to the holding means 81, see FIGS. 19A to 19C.

The tubular component 1 may comprise the cable 7 disposed in the sheath 4, see FIG. 2. The cable 7 is a conductor. The cable 7 may be a data transmission cable. The cable 7 is more flexible than the sheath 4. The cable 7 may be a coaxial type cable, for example of the RG142 or RG316 type. The cable 7 may comprise a core of conductive material, for example copper. Said core may be sheathed with a dielectric. Said dielectric may be surrounded by a conductive material, for example copper, forming an electromagnetic shielding for the core. Said shielding may be surrounded by a protective layer.

The cable 7 may be provided with suitable elements for protecting and/or fixing its portion located axially between the tail surface 24 and the lock 5 in the elongate channel 21 and/or the take-up chamber 22.

The cable 7 mounted in the tubular component 1 comprises at each of its ends a plug 14 adapted to allow connection with the transmission means 8 and/or another cable 7, see FIGS. 6A, 6B and 7. The transmission means 8 is connected to the plug 14 of the cable 7. The connection may be located in the holding means 81. It is also possible to overmould the cable 7 and the transmission means 8 at the connection.

The sheath 4 is assembled with the lock 5. Assembly of the sheath 4 and lock 5 may, for example, comprise welding.

The assembly of the sheath 4 and lock 5 may, for example, comprise matching a ring forming the lock 5 with the shape of the external surface of the sheath 4. This mounting means that the lock 5 can rotate with respect to the sheath 4.

In another embodiment, the step for assembling the sheath 4 and lock 5 and the step for manufacturing the lock 5 are replaced by mechanical deformation of the sheath 4 so as to form a thickened portion. The thickened portion forms the lock 5. The lock 5 may in particular be a body of revolution about the sheath 4.

The sheath 4 is placed in the bore of the primary tube 15 and in the supplemental groove 11. One step consists of placing the lock 5 in the housing 6. The sheath 4 and the lock 5 may be held in place by gravity. The step for assembling the sheath 4 and the lock 5 as well as the step for placing the lock 5 in the housing 6 may be carried out in a selected order. The step for assembling the sheath 4 and lock 5 as well as the step for placing the lock 5 in the housing 6 may be carried out simultaneously, especially if the sheath 4 and the lock 5 are linked, see FIG. 3.

After placing the sheath 4 and lock 5 in the primary tube 15, the elongate channel 21 of the liner 20 is aligned with the sheath 4 and the liner 20 is inserted and positioned in the bore of the first end zone 2 of the primary tube 15, see FIG. 5. The presence of the liner 20 radially clamps the lock 5 in its housing 6 by surface interference between the external surface 31 of the liner 20 and the lower curved surface 58 of the lock 5. The elongate channel 21 accommodates the sheath 4.

In the embodiment of FIGS. 17A and 17B, the sheath 4 is threaded into the portion 21*a* of the elongate channel 21, then the U shaped lock 5 is embedded in the housing 6 of the liner 20 to axially clamp the sheath 4 with the liner 20. The liner 20 is inserted into the first end zone 2.

Mounting may also comprise a step for inserting the cable 7 into the sheath 4 and the lock 5 such that the cable 7 protrudes out of the sheath 4 at both ends. The cable 7 may be threaded into the tube portion 59 of the lock 5. In the embodiment of FIGS. 17A and 17B, the cable 7 is passed through before inserting the liner 20 into the first end zone 2.

Mounting may comprise a step for bringing a plug 14 of the cable 7 into electrical contact with a transmission means 8, for example via a socket, see FIGS. 6A and 6B.

Mounting may comprise a supplemental step carried out after the steps described above, comprising fixing the transmission means 8 to the tubular component 1. The cable 7 may be configured so as to retract into the sheath 4 on fixing the transmission means 8. The cable 7 may, for example, comprise a spiral portion for retraction into the sheath 4.

In a variation, the cable portion 7 which protrudes axially from the tubular component 1 may enter a take-up chamber 22 provided in the liner 20, for example by being coiled.

The step for fixing the liner 20 in a bore of the first end zone 2 may comprise force fitting. The step for fixing the liner 20 in a bore of the first end zone 2 may comprise bonding. Axial positioning of the liner 20 in the bore of the first end zone 2 may be carried out by surface interaction, for example by snap fitting. Axial positioning of the liner 20 in the bore of the first end zone 2 may be carried out by aligning the surfaces. Rotational indexing of the liner 20 in the bore of the first end zone 2 may be carried out such that the elongate channel 21 faces the sheath 4.

The step for fixing the liner 20 in the bore of the first end zone 2 may be reversible. The reversibility of fixing the liner 20 may be facilitated by tapped holes 34. The tapped holes 34 are located in the thickness of said liner 20. Said tapped holes 34 may cooperate with the screw threads of a machine tool with a force greater than the friction between the liner 20 and the bore of the first end zone 2 to withdraw the liner 20 from the end zone 2. Fixing of the liner 20 in the first end zone 2 may be considered to be reversible and the liner 20 may be considered to be detachable even in the presence of adhesive, as this latter is destroyed. When a solid adhesive is used, the component may be heated. Heating may be up to approximately 500° C. The combination of heating and application of mechanical force can remove the liner 20 while preserving the primary tube 15.

The method for dismantling a tubular component 1 may comprise removing the liner 20 from the bore of the first end zone 2, for example in the manner described in the preceding paragraph. Dismantling a tubular component 1 may include one or two step(s) for removing the sheath 4 and lock 5 from the tubular component 1. Removal of the liner 20 precedes removal of the sheath 4 and lock 5. The sheath 4 and the lock 5 may be removed manually or at least just using human strength.

Wear of the primary tube 15 may result in machining, for example of the small diameter annular surface 17, during maintenance. As illustrated in FIGS. 19A to 19C, the tail terminal surface 24 may be machined to adapt it to wear of the primary tube 15. Machining the tail terminal surface 24 means that the length of the liner 20 can be matched to the distance between the shoulder 10 and the annular small diameter surface 17 of the primary tube 15. Machining may be carried out several times during the life of a component 1. FIG. 19A shows a liner 20 before machining on which a transmission means 8 has been placed. FIG. 19B shows a liner 20 during shortening, the transmission means 8 having been removed. FIG. 19C shows a liner 20 after shortening, the transmission means 8 having been replaced. In FIGS. 19A to 19C, the cabling and the sheath 4 have not been shown. In order to protect the cabling elements, for example the plug 14, a stopper 80 may be positioned in the elongate channel 21 or a second elongate channel portion 21*b*. The channel 21 may then comprise surface means 21*c* provided to facilitate positioning and maintaining of the stopper 80. The stopper 80 improves protection of the cabling elements against chips and fluids that may be present during machining of the liner 20. The use of the stopper 80 is particularly beneficial when machining is carried out without removing the cable 7 completely from the component 1. In the case of a highly elastic and/or helical sheath 4, machining may be carried out by pulling the liner 20 from the first end zone 2 but without detaching the sheath 4 and/or the cable 7 from the liner 20. The sheath 4 is then stretched in part from the exterior of the first end zone 2. In a variation, machining is carried out in a similar manner from the side of the head terminal surface 23.

The component comprises a dual lock system. The lock 5 or anchor point or U-shaped staple constitutes a first, axial lock by mechanical interaction with the housing 6. The liner 20 constitutes a second lock, at least radial, clamping the first lock 5.

The invention is not limited to the methods and apparatus described above, given solely by way of example, but encompasses any variations which the skilled person could foresee within the scope of the claims below.

The invention claimed is:

1. A tubular component for a drill stem that can be cabled, comprising:

a first end zone;

a second end zone;

a sheath extending between the first end zone and the second end zone;

a cable disposed at least in part in the sheath;

a liner, the liner being fixed in a bore of the first end zone and including at least one take-up chamber for the cable; and a lock to clamp the sheath at least in an axial direction with respect to the first end zone, the lock being installed such that the lock can be dismantled in a housing, the lock being held radially in the housing, wherein a length of the cable is greater than a distance between the first end zone and the second end zone such that the take-up chamber can store an excess length of the cable.

2. The component according to claim 1, further comprising a second supplemental liner fixed in a bore of the second end zone, the second supplemental liner also including at least one take-up chamber for the cable.

3. The component according to claim 2, wherein the cable is defined such that the excess length of cable which can be stored in the take-up chamber of the liner has a dimension that differs from that of an excess length of cable which can be stored in the take-up chamber of the second supplemental liner.

4. The component according to claim 1, wherein the take-up chamber has an axial length which is at least twice, or at least three times, smaller than the excess length of the cable.

5. The component according to claim 1, wherein an outside of the cable includes a retaining stopper to calibrate a length of the cable coming from at least one side of the sheath.

6. The component according to claim 1, wherein the liner is traversed by an elongate channel that allows the sheath and/or the cable to pass from the chamber to terminal surfaces of the liner.

7. The component according to claim 6, wherein a bore of the first end zone comprises a shoulder in a vicinity of a head terminal surface of the liner, a supplemental groove provided through the shoulder, the sheath being disposed in the supplemental groove, at least one of the elongate channel and the supplemental groove housing the sheath being of constant section that matches the sheath.

8. The component according to claim 1, further comprising a tube having a constant diameter bore disposed between the first end zone and the second end zone.

9. The component according to claim 1, wherein the liner comprises an external surface including a guide portion and at least one fixing portion.

10. The component according to claim 1, further comprising a means for transmission from one component to another component, the transmission means being connected to the cable, the transmission means being supported by the liner.

11. The component according to claim 1, wherein the lock is radially held in the housing between the liner and the first end zone.

12. The component according to claim 1, wherein the sheath is angularly held with respect to an axis of the component by the liner or by the lock.

13. The component according to claim 1, wherein the sheath and the cable form a unitary sub-assembly, the sub-assembly comprising a coaxial cable.

14. A method to mount a cable in a tubular component of a drill stem, the component including a first end zone, a second end zone, a sheath extending between the first end zone and the second end zone, and a liner fixed in a bore of the first end zone, the liner including an elongate channel and a take-up chamber for a cable, the cable protruding from either end zone of the component, the method comprising:

electrically connecting the cable with a transmission mechanism;

pushing an excess length of protruding cable to an elongate channel portion, a supplemental portion entering the take-up chamber;

bringing a plug of the cable located axially on a side of the first end zone of the component in a mounted state into electrical contact with the transmission mechanism, with electrical contact being made after inserting the cable into the sheath; and fixing the transmission mechanism to the component, pushing the excess length of the cable protruding axially from the component into the elongate channel portion causing a supplemental portion of cable to be deployed in the take-up chamber provided in the liner, with fixing of the transmission mechanism being subsequent to bringing the plug into electrical contact.

* * * * *